US005398477A

United States Patent [19]

Philipp et al.

[11] Patent Number: 5,398,477

[45] Date of Patent: Mar. 21, 1995

[54] SHAFT ELEMENTS MADE FROM MOLDING MATERIAL

[75] Inventors: Peter Philipp, Blaubeuren; Richard Kraiss, Laichingen-Suppingen, both of Germany

[73] Assignee: Georg Prinzing GmbH & Co. KG Betonformen-und Maschinenfabrik, Blaubeuren, Germany

[21] Appl. No.: 81,390

[22] PCT Filed: Dec. 10, 1991

[86] PCT No.: PCT/DE91/00980

§ 371 Date: Jun. 25, 1993

§ 102(e) Date: Jun. 25, 1993

[87] PCT Pub. No.: WO92/12297

PCT Pub. Date: Jul. 23, 1992

[30] Foreign Application Priority Data

Jan. 5, 1991 [DE] Germany ..... 41 00 160.5

[51] Int. Cl.[6] ..... E04C 5/30

[52] U.S. Cl. ..... 52/726.5; 182/93

[58] Field of Search ..... 52/19, 20, 21, 726.5; 404/25, 26; 182/93

[56] References Cited

U.S. PATENT DOCUMENTS

| | | | |
|---|---|---|---|
| 994,133 | 6/1911 | De Jonge | 182/93 X |
| 3,745,738 | 7/1973 | Singer . | |
| 4,328,880 | 5/1982 | Lapeyre | 182/93 |

FOREIGN PATENT DOCUMENTS

| | | |
|---|---|---|
| 3110185 | 9/1982 | Germany . |
| 54-20846 | 3/1978 | Japan . |
| 498987 | 11/1970 | Switzerland . |
| 209931 | 2/1924 | United Kingdom . |

OTHER PUBLICATIONS

Patent Abstracts of Japan, vol. 7, No. 209 (C-186) (1354), 14 Sep. 1983 & JP,A,58109568 (Asahi Kasei Kogyo K.K.), 29 Jun. 1983.

Database WPIL, Accession No. 86-114758 [18], & ES-,A,8601283 (Sanchez J C), 16 Feb. 1982.

*Primary Examiner*—Carl D. Friedman

*Assistant Examiner*—Creighton Smith

*Attorney, Agent, or Firm*—Michael J. Striker

[57] ABSTRACT

A shaft element composed of molding material has a shaft member with a hollow interior, and at least one support provided in the interior of the shaft member so that a person can step on the support. The support is an integral component part of the shaft member. The shaft member has an extension, and the support is formed in the region of the extension.

45 Claims, 24 Drawing Sheets

SHAFT ELEMENTS MADE FROM MOLDING MATERIAL

GROUNDS OF THE INVENTION

The patent invention relates to a shaft article made from molding material.

Shaft elements of the above-mentioned general type are known in the art, for example in the patent document GB-A-209 931. These shaft elements have a uniform wall thickness over their circumference and one-piece supports which are formed as substantially gallery-like inwardly extending projections. On a plane view, the projections have substantially the shape of a hollow basin. Such projections are difficult to make during the manufacture. They are also subjected to loads and can be easily broken.

The patent document JP-U-54 20 846 discloses a finished molding which is provided inwardly on the wall with two wall thickenings extending at a distance from one another. They are arranged so that subsequently the ends of special rods can be inserted and fixed by securing elements. These special rods form the supports.

The patent document U.S. Pat. No. 3,745,738 shows shaft elements which are provided inwardly with a separate element composed for example of polyester material and having openings so as to form a conductor. This separate element is mounted on the shaft element.

Such shaft elements are also known from DE-PS 31 10 185. They have in their interior at least one support on which a person can step. The support is formed by a step iron which is molded in along with the finished molded article with the aid of a special installing device as part of the mold device during the production and molding of the finished molded article. For example, if the finished molded article includes a manhole element or shaft element, e.g. a shaft ring, made from concrete, the step irons are embedded in the concrete from the inside during the molding process. These step irons must be acquired at a particularly high cost, stored and loaded, fed to the mold device during the molding process and placed. This is involved and expensive. There is also a risk of corrosion, depending on the material from which the step irons are formed. For this reason, shafts designed in this way bring about increased maintenance and inspection costs. Iron step irons involve the risk of spark formation and thus the danger of explosions in shafts containing highly flammable or explosive media. Since the step irons are often smooth and generally slippery in the interior of the shaft, the danger of slipping when climbing them is not entirely excluded. Another disadvantage with respect to manufacture consists in the wide range of shapes and dimensions of commercially available step irons. For this reason alone, the mold devices for the production of the finished molded articles must be adapted to a great number of different designs of step irons. Consequently, it is necessary to provide correspondingly adapted mold devices, which is extremely costly.

SUMMARY OF THE INVENTION

Accordingly, it is an object of the present invention to provide a shaft element which avoids the disadvantages of the prior art.

More particularly, it is an object of the present invention to provide a shaft element which dispenses with separate step irons without sacrificing strength and leads to a reduction in cost.

In keeping with these objects and with others that will become apparent hereinafter, one feature of the present invention resides, briefly stated, in a shaft article made from molding material provided in its interior with at least one support on which a person can step and which is an integral part of the shaft element made from the molding material, wherein in accordance with the present invention the respective support is constructed in the region of a thickened wall portion or at or in an internal intermediate wall of the shaft element.

Separate step irons as independent elements to be integrally molded during the molding process are completely dispensed with in that at least one support forms an integral component part with the manhole or shaft element and is molded along with the shaft element from the molding material of the latter during the molding process. The costs incurred by acquisition, storage and preparation, as well as insertion in the mold device, are entirely eliminated. This leads to a considerable reduction in labor time and costs. Accordingly it is no longer necessary to interrupt the automatic manufacturing process which, depending on the process flow, was formerly necessary particularly for the insertion of the step irons. The automatic manufacturing process can proceed without interruption. Increased expenditure on maintenance and inspection of shafts formed from such shaft elements due to the susceptibility of step irons to corrosion is eliminated as is the risk of spark formation and accordingly the danger of explosion. Also, ample freedom is provided with respect to the design of the shaft element due to the integral construction of the support which is molded along with the shaft element. This design freedom is no longer hampered by the step iron which had to be incorporated as a separate element. Thus, there are fewer restrictions with respect to the shapes, dimensions and special designs of the finished molded articles and a greater design freedom is provided. The molding material itself provides a relatively rough surface, depending on which molding material is used, so that the supports which are integrally molded already ensure greater protection against slipping. If the shaft element is made e.g. from concrete there is a relatively rough concrete surface in the region of the supports which increases protection against slipping. .Also, the person having to enter the shaft formed from such shaft elements has on the whole a greater sense of security as a result of the inserted supports and increased protection against slipping. Repair work which may be required in the shaft can accordingly also be carried out more easily and safely and thus more willingly. A further advantage consists in that shaft element can accordingly be produced integrally with all elements in a single process so as also to ensure greater impermeability or tightness in the production process. Thus the advantages include a substantial reduction in cost, decreased production time, a greater design freedom with respect to the shape and dimensioning of the shaft element, as well as greater stability, safety, service life, and ease of maintenance and repair.

All possible types and mixtures of concrete may be used, including concrete/polymer composite, sulfur concrete or the like concrete materials as well as fiber concrete and the like. By forming the respective support in a thickened region of a wall, specifically in an internal or external thickened portion of a wall, or at or in an inner intermediate wall of the shaft element, a possible weakening in the cross section of the shaft element is prevented in the area where the supports are inserted, so that the shaft element has a strength at least equal to that of the known shaft element. This is effected with molded in supports which are uniform with respect to the material of the shaft element and are constructed in particular as recesses. When these supports are arranged in the region of an internal thickened wall portion, e.g. a longitudinally extending cross piece, this thickened wall portion can also be used for other purposes, e.g. for forming a handrail or the like.

Further advantageous features of the invention are specified below shaft element 32. The coat of paint improves the visibility of the supports and, depending on the paint, also enables protection against corrosion. It is particularly advantageous that the shaft element be made of concrete having a water/cement ratio of 0.4 of less. The shaft elements are advantageously compacted, particularly vibro-compacted. This is performed e.g. according to the known vibrating pressing process. In so doing, the concrete is compressed by vibration and then promptly released from the formwork or mold. This is effected in every case before the binding agent of the molding material has bonded. The manufacturing sequence for the production of such shaft elements is fully automatic. The shaft element is released from the formwork immediately after compaction and—resting on a lower bottom ring (bottom socket)—transported elsewhere.

Further details and advantages of the invention are mentioned in the following description.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1A:
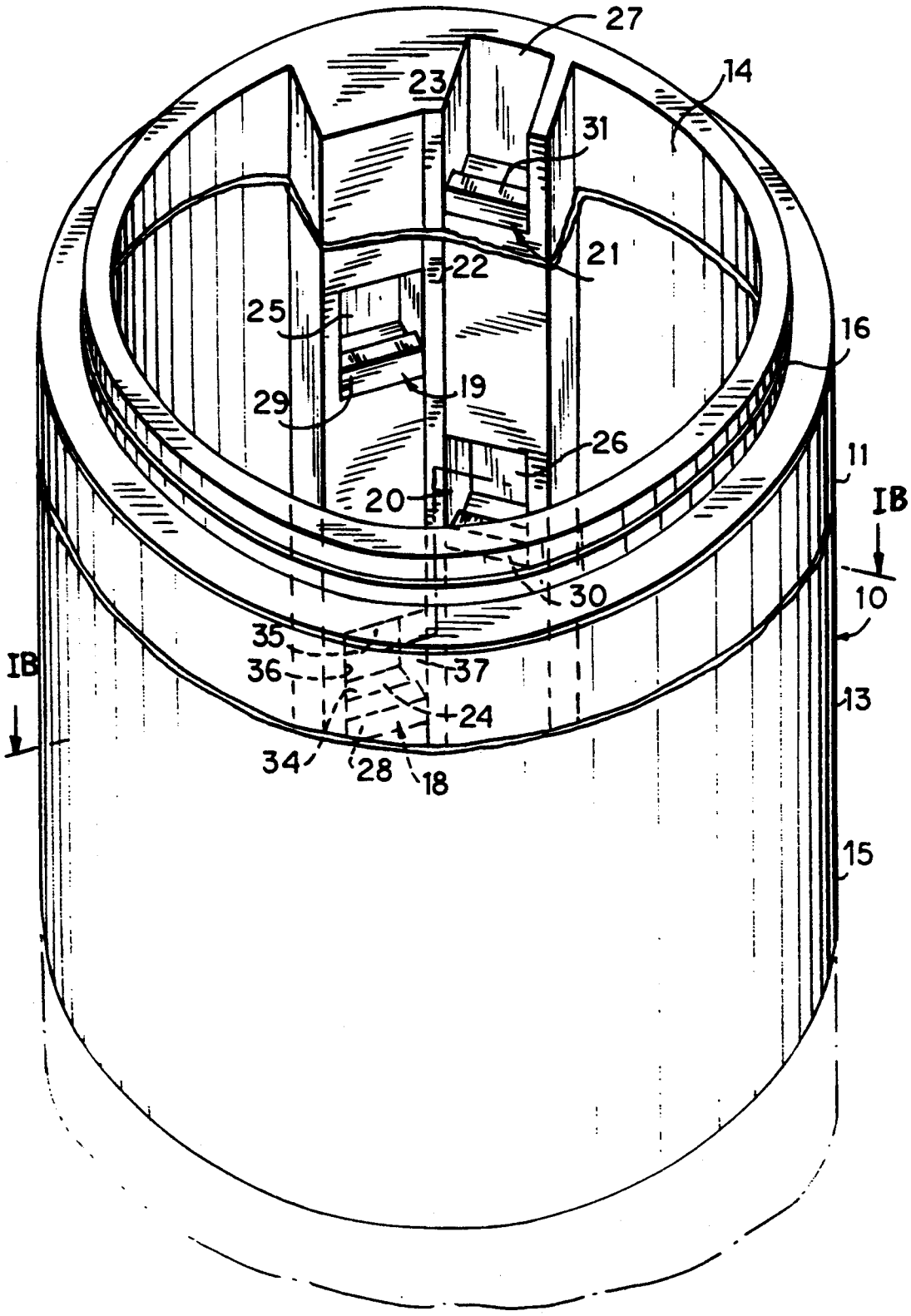
FIG. 1*a* is a perspective view of the follow shaft element according to the first embodiment example.

It is noted at the outset that all twelve embodiment examples according to FIGS. 1 to 33 refer to a finished molded article 10 of molding material, made particularly from concrete, including fiber concrete, sulfur concrete or the like, or from ceramic material or plastics or the like. The finished molded article 10 has a hollow shaft element 11. The latter can be a shaft ring, vertical shaft or taper shaft ring, pipe or the like which is generally arranged in an upright manner when installed. Its center line 12 thus extends substantially vertically. However, this is not compulsory. The shaft element 11 shown in the drawings which is at least substantially tubular, e.g. cylindrical, is also not compulsory. The shaft element 11 can also have a conical or polygonal, e.g. rectangular, oval, elliptical or other shape. All of the different shapes lie within the scope of the invention.

The shaft element 11 in the embodiment examples shown in the drawings has a wall 13 which is defined by a curved inner surface 14 and a curved outer surface 15. The cross section of the wall 13 is at least substantially uniform apart from the exceptions specifically mentioned in the following description. Each shaft element 11 is provided at both ends with folds or flanges 16 and 17 which are shaped in a conventional manner and enable a plurality of successive shaft elements 11 to fit one inside the other so as to effect a sealing therebetween. The shaft element 11 is designed e.g. according to DE-PS 31 10 185 to which reference is made and whose content is disclosed here.

Figure 1B:
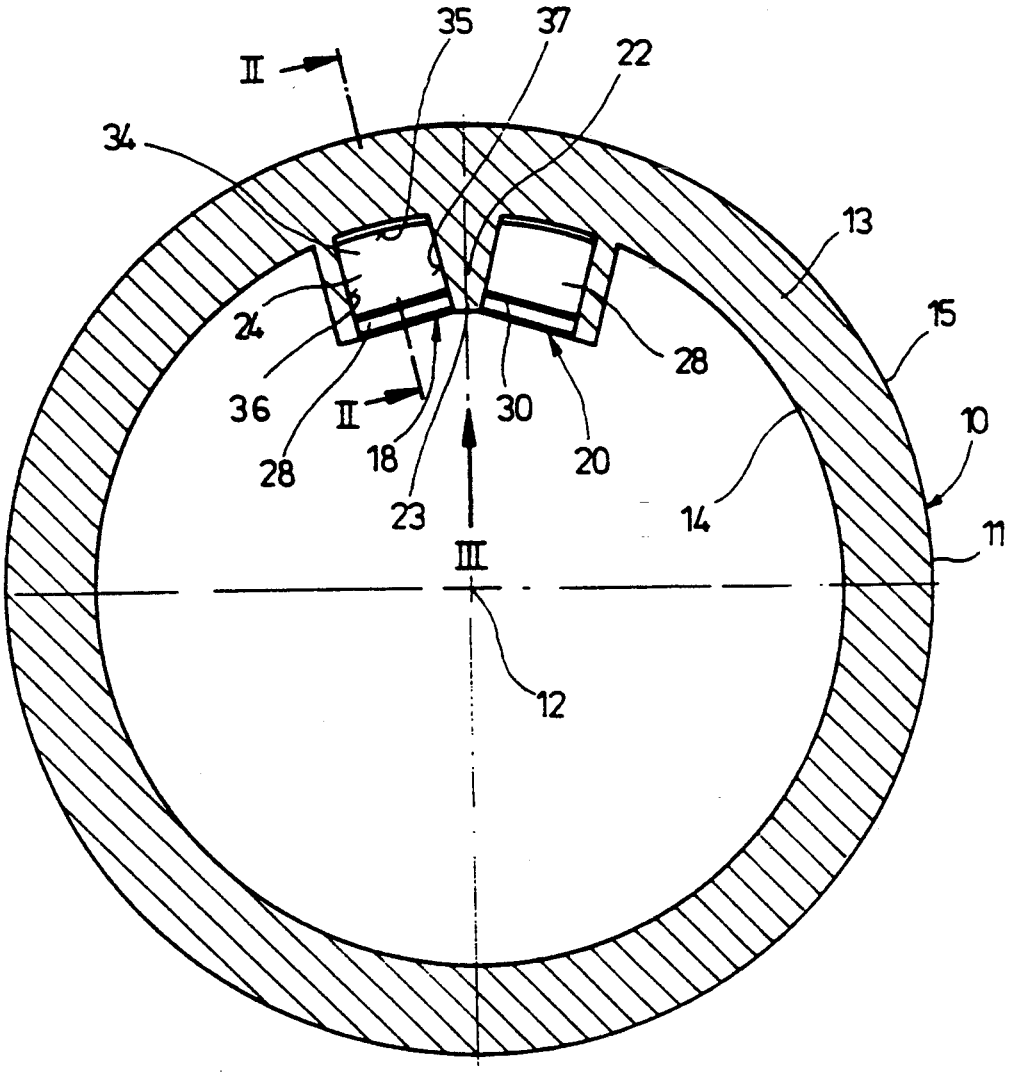
FIG. 1 shows a schematic horizontal section of an upended hollow shaft element according to a first embodiment example.
Figure 2:
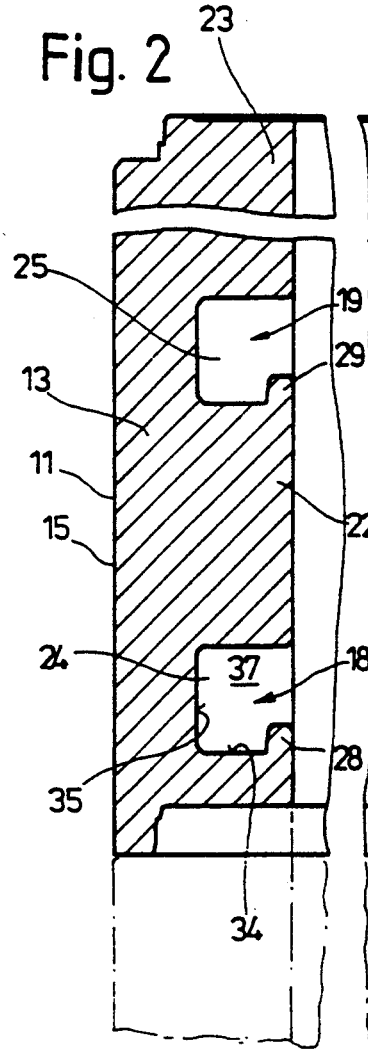
FIG. 2 shows a schematic section along line II—II in FIG. 1.
Figure 3:
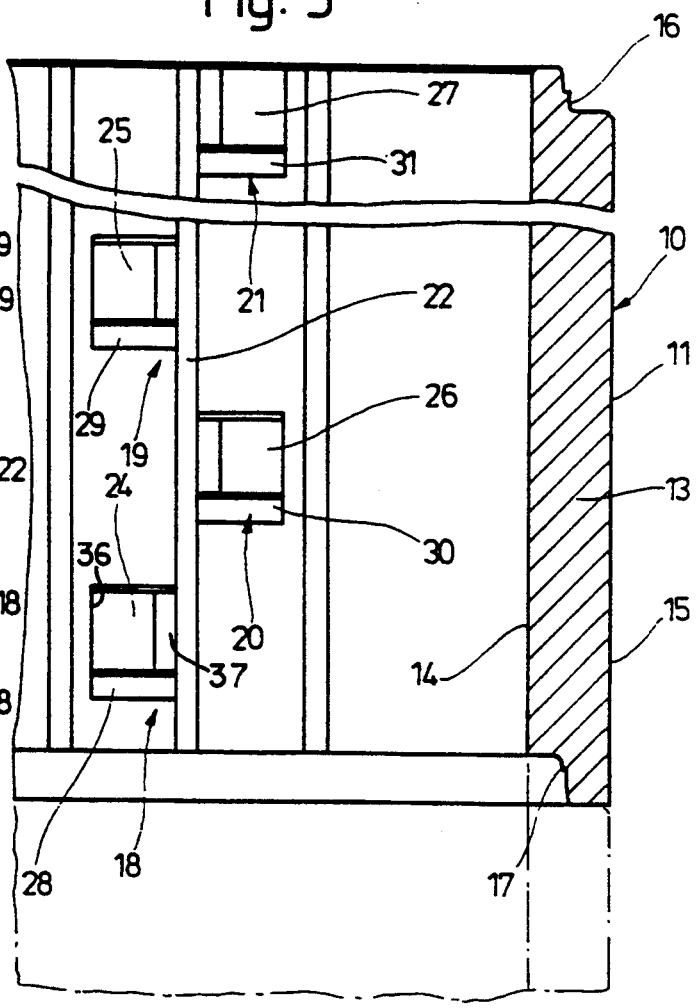
FIG. 3 shows a side view in partial section in the direction of arrow III in FIG. 1.

The shaft element 11 has at least one support 18 in its interior on which a person can step. The first embodiment example in FIGS. 1 to 3 shows a total of four supports 18, 19 and 20, 21 with which the shaft element 11 is outfitted. In the case of the shaft element 11 according to DE-PS 31 10 185, these supports are formed by step irons which are embedded in the shaft element 10, particularly the shaft element 11, from the inside during the molding process. These step irons are prefabricated from cast iron, special steel, special steel pipe with plastic sheathing, aluminum, aluminum pipe, aluminum pipe with plastic sheathing or from other material. These step irons are costly. The cost of producing the step irons is in itself high. It requires corresponding raw materials and use of energy for production. Further, such step irons are subject to corrosion, for which reason shaft elements 11 outfitted with such step irons require inspection and maintenance. The acquisition, storage, preparation and installation of such step irons during the production process is obviously likewise extremely expensive. Other critical disadvantages are evident and need not be described in detail here.

No separate step irons are required for forming the supports 18 to 21 in the finished molded article 10, particularly the shaft element 11, according to the invention. Nor is it necessary to embed the step irons in concrete separately during production. Rather, the supports 18 to 21 are integral component parts of the shaft element 11 which are uniform with respect to material and can be molded along with the shaft element from the molding material of the latter so as to be formed in the finished product. Although a plurality of supports, namely four supports 18 to 21, are provided in the first embodiment example according to FIGS. 1 to 3, it goes without saying that at least one support in the shaft element 11 can also be sufficient.

In the first embodiment example in FIGS. 1 to 3, the respective support 18 to 21 projects inward over the inner surface 14 of the shaft element 11. The supports 18 to 21 are constructed in an inner thickened wall portion 22 of the shaft element 11. The inner thickened wall portion 22 is substantially constructed as a web or ridge 23 of considerable width which extends longitudinally, e.g. along an inner surface line of the shaft element 11. In the first embodiment example, this ridge 23 has at least a slight V shape as seen in horizontal section according to FIG. 1.

As can be seen from the drawing, the supports 18 to 21 are formed from recesses 24 to 27 provided in the interior of the ridge 23. The ridge 23 has the approximate shape of a longitudinal ledge, in this case a longitudinal ledge with an approximately rectangular cross section which is arranged at the inner surface 14 and in so doing follows the curved shape of the inner surface 14 and, further inward, has outer surfaces which are slightly inclined relative to one another. Of course, this longitudinal ledge is integral with the wall 13.

In the first embodiment example, the supports 18 to 21, particularly recesses 24 to 27, in the ridge 23 are arranged in double formation so as to be offset relative to one another. This means that the two recesses 24 and 25 are arranged one above the other along a line and, in like manner, the other two recesses 26 and 27 are also arranged one above the other along a line, the two lines extending approximately parallel to one another at a distance from one another. The recess 26 is vertically offset relative to the recess 24, as is likewise the recess 27 relative to the recess 25.

When arranged in double formation, the supports 18 to 21 can have a width of roughly 125 to 150 mm and when arranged in single formation they can have a width of approximately 300 to 400 mm.

As seen in cross section, the recesses 24 to 27 are each roughly quadrangular, e.g. rectangular or square. As can be seen particularly in FIGS. 1 and 3, the recesses 24 to 27 have a substantial width so that they are particularly apt as foot supports. In this regard, one especially important aspect consists in that each of the supports 18 to 21, particularly recesses 24 to 27, have a vertically projecting, approximately horizontally extending foot crosspiece 28 to 31 which adjoins the inner surface of the ridge 23 and is preferably provided with a substantially planar upper side so as to provide a favorable stepping surface for the foot. The foot crosspiece 28 to 31, which is aligned horizontally and accordingly approximately at a right angle to the center line 12, extends in a straight line in the first embodiment example.

It can also be seen that the respective recess 24 to 27 is constructed in a roughly boxlike manner as seen in cross section in the first embodiment example according to FIGS. 1 to 3.

As shown by way of example exclusively in the case of recess 24, this recess 24 has a base 34, an end wall 35 defining the interior of the recess, and two side walls 36 and 37 at both sides which extend roughly parallel to one another and ensure a good and secure lateral guidance for the part of the foot engaging in the recess 24 when stepping on the foot crosspiece 28. As can be seen, the foot crosspiece 28 projects upward over the base 34. The other recesses 25 to 27 are designed in the same manner as explained above with respect to the recess 24. The base 34 of the respective recess 24 to 27 extends approximately horizontally in this instance. The inner end wall 35 which defines the depth of the recess 24 extends in a curved manner according to FIG. 1 approximately following the curvature of the inner surface 14.

The supports 18 to 21 which are formed so as to be integral with the Shaft element 11 result in a generally homogeneous finished molded article 10. There is no need for special additional step irons with all of the disadvantages resulting from them. Accordingly, the cost of acquiring and storing such additional step irons is eliminated completely. Moreover, there is also a savings in energy and raw material, since additional step irons are no longer necessary. Further, the cost of maintaining shafts formed from such shaft elements 11 is considerably reduced. Also, spark formation which can occur in iron step irons is prevented. The danger of explosions in shafts filled with highly flammable or explosive media is accordingly eliminated or at least substantially reduced. The integral construction of the supports 18 to 21 provides greater design freedom for such finished molded articles 10, particularly shaft elements 11. A positive influence can accordingly be exerted with respect to the safety and ergonomics of climbing and the like parameters through the design. Protection against slipping is also considerably increased. This is achieved e.g. by the vertically projecting foot crosspieces 28 to 31 which can also be grasped with the hand and by the boundary formed on both sides by the side walls 36 and 37 which prevents slipping to the side. Another advantage consists in that the integral design of the supports 18 to 21 favorably influences the sense of security of the person entering the shaft designed in this way as a result of the massive construction of the supports 18 to 21 for the foot. A further advantage consists in that the mold devices required for the manufacture of the finished molded articles 10, particularly the shaft elements 11, need no longer be adapted to the constantly changing shapes and dimensions of step irons. Also, the elements of the mold device can now be constructed with a smaller and accordingly tighter fit with the advantage that possible leaking of liquid concrete, e.g. concrete sludge, into the interior of the mold device during the molding process for concrete parts is prevented. A further advantage consists in that insertion devices formerly required for inserting the separate step irons can be dispensed with, which leads to a further reduction in cost. The work steps for loading an insertion device with step irons and introducing the insertion device into the mold device are also dispensed with, leading to a further reduction in cost. Since there are no step irons to be stored, transported and handled, the added time and interruptions in the automatic manufacturing process are eliminated. The invention enables a continuous, fully automated production. The finished molded article 10, particularly the shaft element 11, is of uniform quality and consistent tightness also in the region of the supports 18 to 21. On the whole, there is an enormous reduction in cost, higher stability, tightness, security, a long service life, ease of maintenance, reduction in production time, and a greater freedom in the design of the finished molded article 10.

Figure 4:
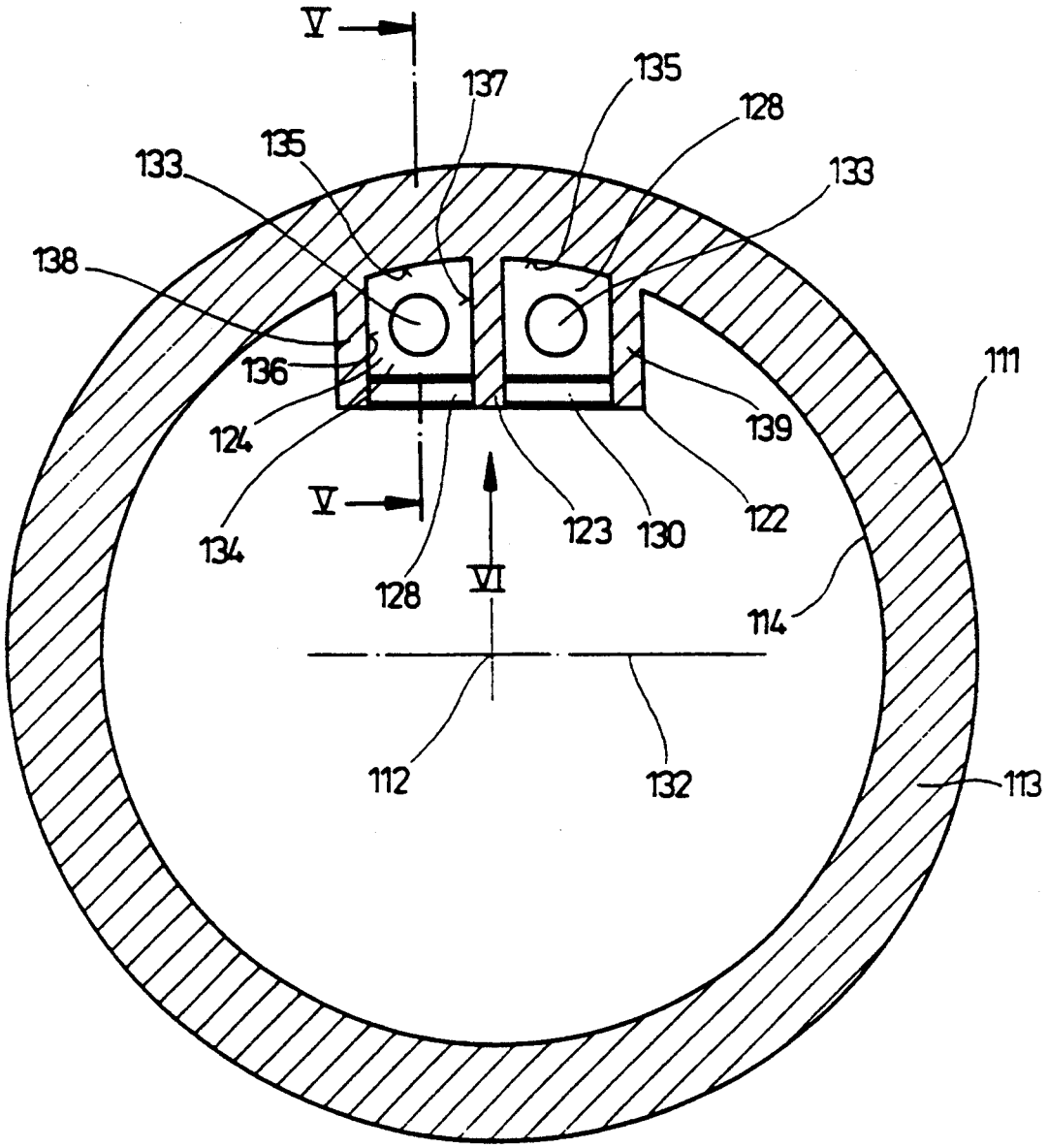
FIG. 4 shows a schematic horizontal section of an upended shaft element according to a second embodiment example.
Figure 5:
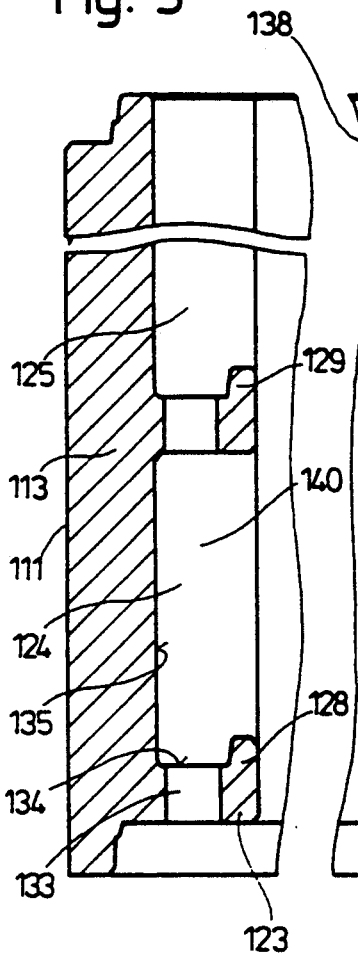
FIG. 5 shows a schematic section along line V—V in FIG. 4.
Figure 6:
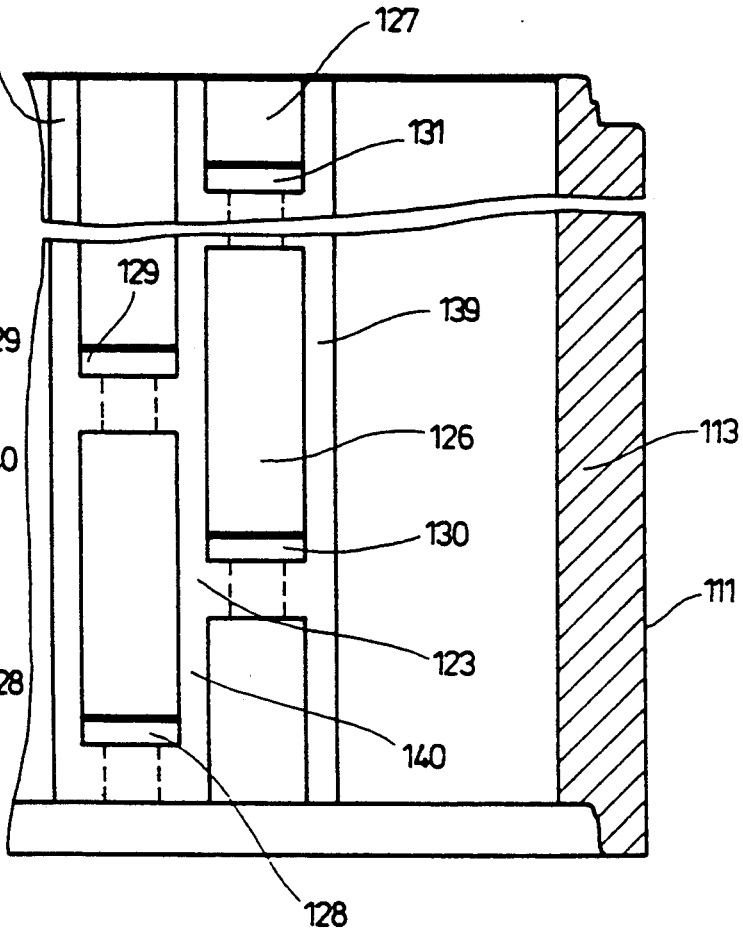
FIG. 6 shows a schematic view in partial section in the direction of arrow VI in FIG. 4.

In the second embodiment example shown in FIGS. 4 to 6, parts corresponding to those in the first embodiment example have reference numbers which are increased by 100 so that the description of the first embodiment example can be referred to in order to avoid repetition.

The second embodiment example differs from the first embodiment example on the one hand in that the foot crosspieces 128 to 131 extend along a secant and thus approximately parallel to a vertical diametral plane 132 of the shaft element 111. Moreover, the recesses 124 to 127 are constructed as elongated, i.e. endwise, rectangles so that a large amount of space is provided above the foot crosspieces 128 to 131. The ridge 123 is designed as a ledge which is roughly rectangular in cross section, its inner surface being aligned approximately parallel to the vertical diametral plane 132. The two side walls 136 and 137 of the recess 124 which extend parallel to one another are in this instance aligned substantially at a right angle to the diametral plane 132 and accordingly along a secant and not radially as in the first embodiment example. Naturally, the side walls of the other recesses 125 to 127 are constructed in the same manner.

By way of addition to the first embodiment example, the base 134 of each recess 124 to 127 in the second embodiment example is provided with at least one passage 133, in this instance formed by a bore hole, which opens downward e.g. extends approximately parallel to the center line 112. In a corresponding manner, the other recesses 125 to 127 also have a passage in the base corresponding to the passage 133. The advantage of this passage consists in that liquids are prevented from collecting in the base region of every recess 124 to 127 in that liquid can flow out through these passages 133 in a downward direction. There is also a cleaning effect in the region of the respective recess 124 to 127. The production of the shaft element 111 is simplified in that the foot crosspieces 128 to 131 in the second embodiment example are aligned with one another and extend approximately parallel to the vertical diametral plane 132 leading through the center line 112.

Figure 7:
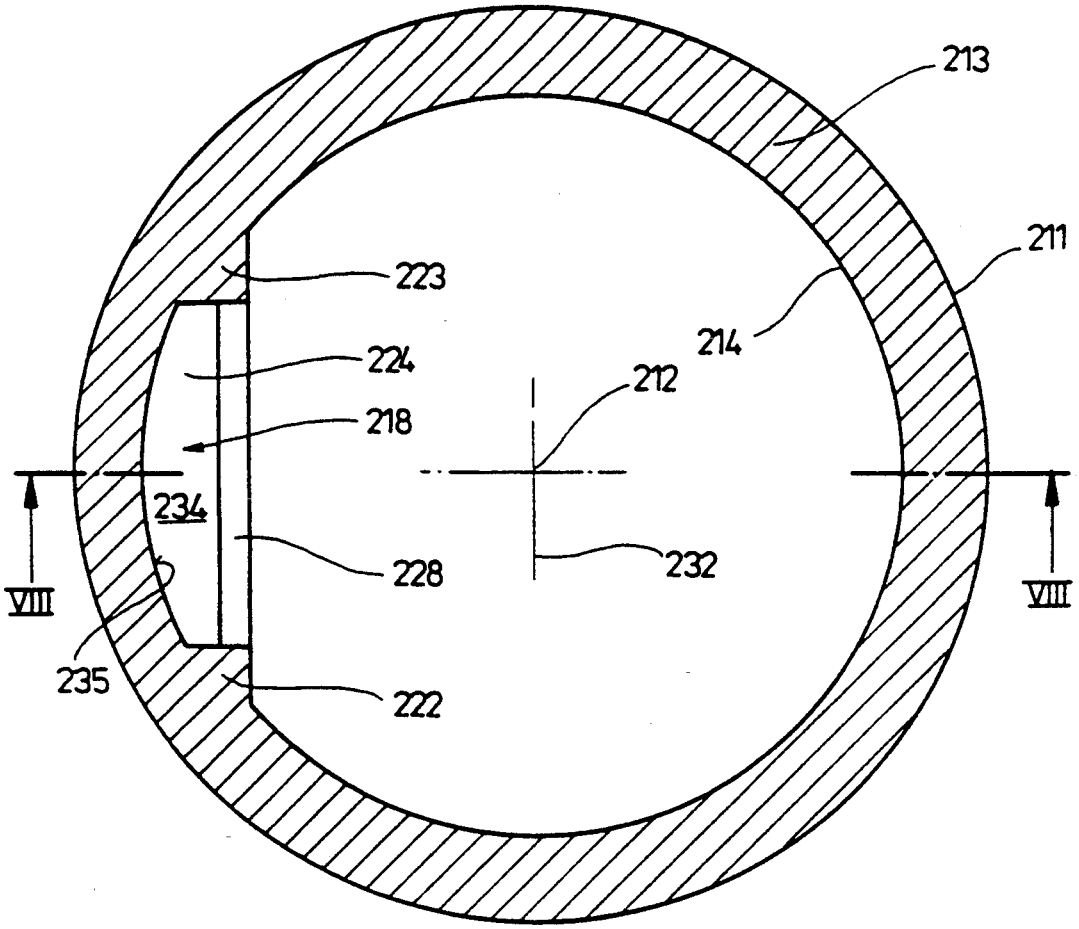
FIG. 7 shows a schematic horizontal section of an upended shaft element according to a third embodiment example.
Figure 8:
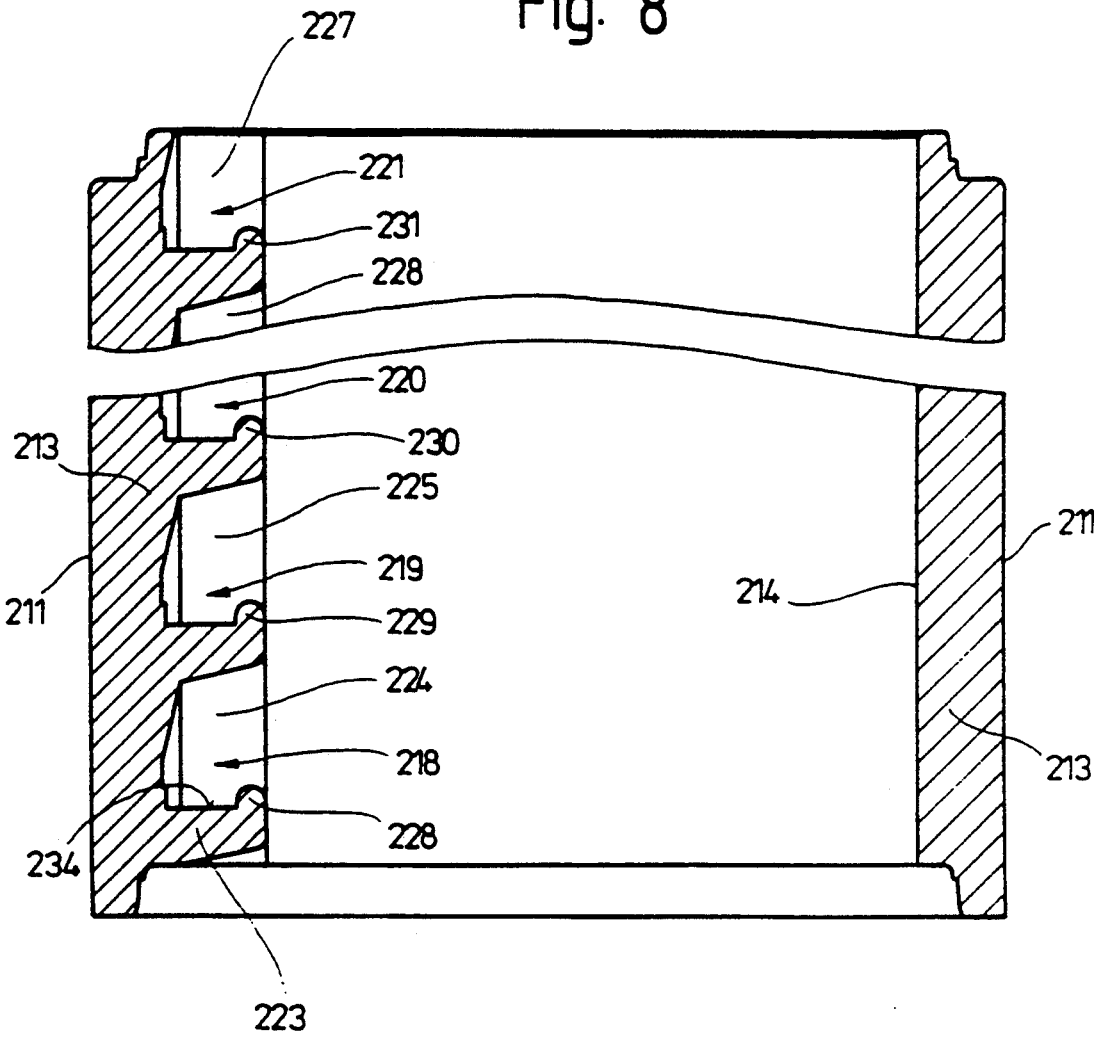
FIG. 8 shows a schematic section along line VIII—VIII in FIG. 7.

In the third embodiment example according to FIGS. 7 and 8, the supports 218 to 221 likewise project inward over the inner surface 214 of the shaft element 211, the supports being formed here by recesses 224 to 227 contained in a ridge 223. The ridge 223 has a greater width here. Its outer surface also extends substantially parallel to a diametral plane 232 passing through the center line 212. In this third embodiment example, in contrast to the first and second embodiment examples, the supports 218 to 221, particularly the recesses 224 to 227, are arranged in single formation one above the other. The recesses 224 to 227 are also very wide as seen in horizontal cross section, but have a smaller radial depth. The large width results in correspondingly wide foot crosspieces 223 to 231. This results in the advantage that the upper foot crosspieces can be used favorably as handles for grasping when climbing the ladder designed in this way. Of course, this is also possible in the preceding embodiment examples depending on the design. But the design according to this third embodiment example is specifically intended for this purpose.

Figure 9:
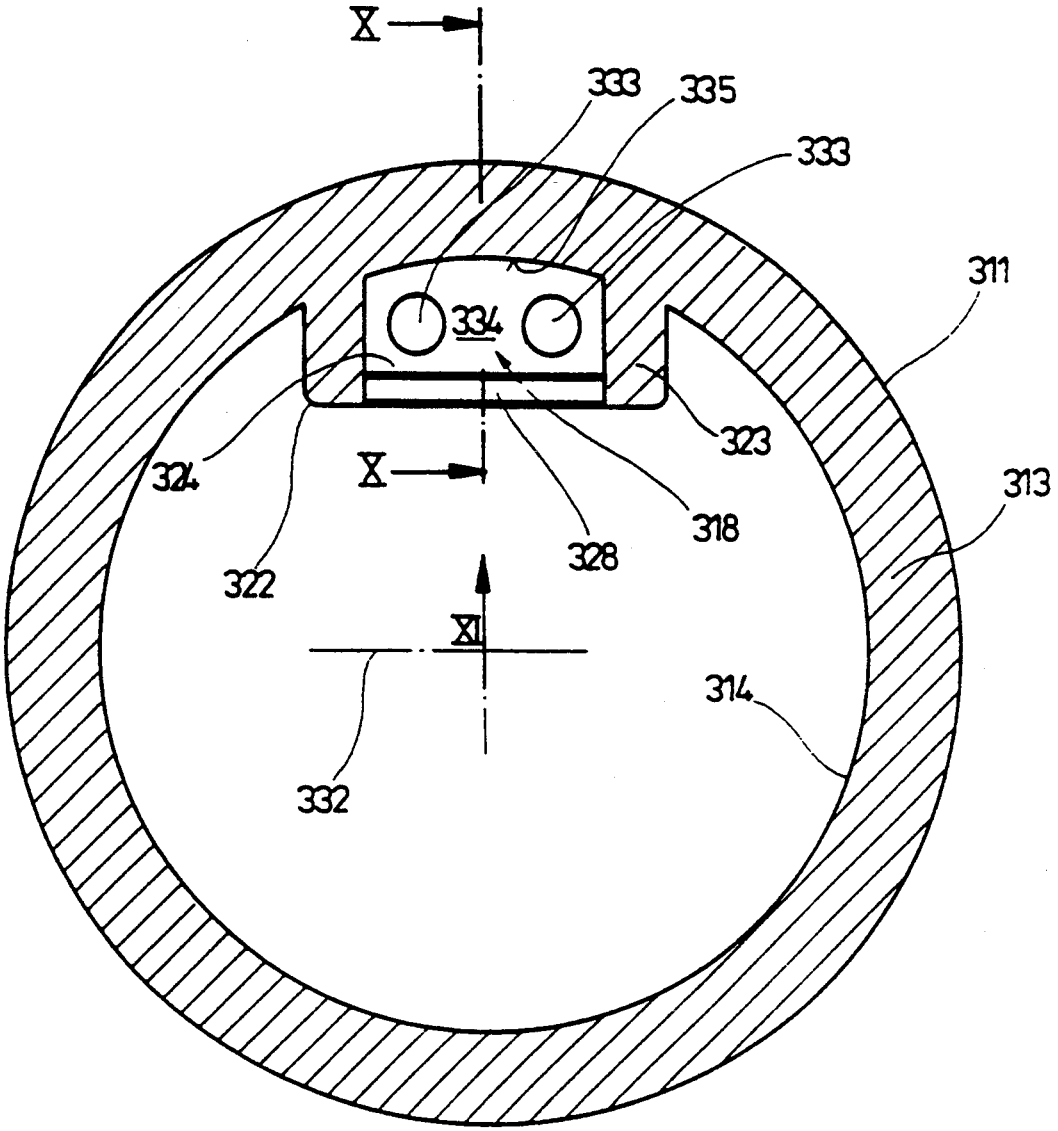
FIG. 9 shows a schematic horizontal section of an upended shaft element according to a fourth embodiment example.
Figure 10:
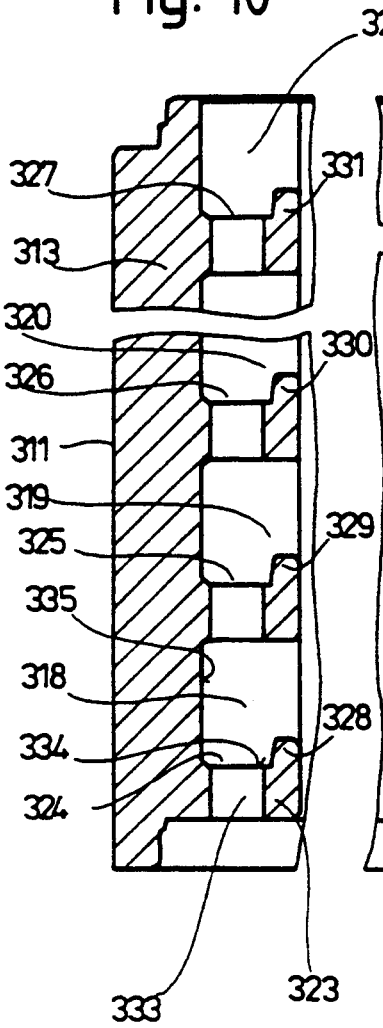
FIG. 10 shows a schematic section along line X—X in FIG. 9.
Figure 11:
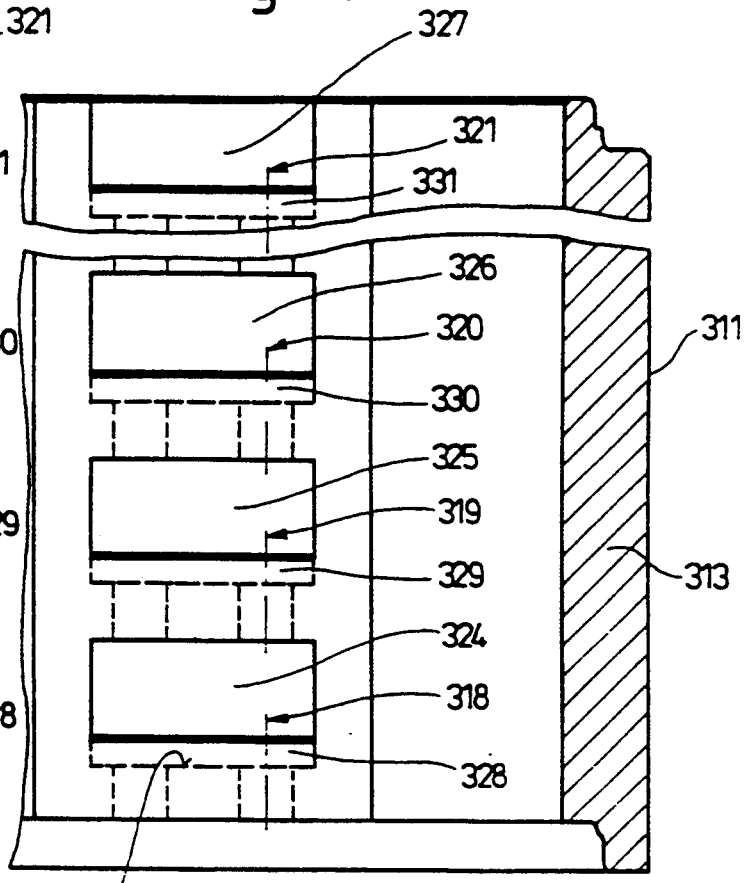
FIG. 11 shows a schematic side view in partial section in the direction of arrow XI in FIG. 9.

The fourth embodiment example shown in FIGS. 9 to 11 is similar to the second embodiment example in FIGS. 4 to 6. However, in the fourth embodiment example according to FIGS. 9 to 11 the supports 318 to 321, particularly the recesses 324 to 327, are arranged one above the other in single formation. Accordingly, with identical dimensioning of the ridge 323, this results in substantially broader foot crosspieces 328 to 331 which can also be grasped by the hand if necessary when climbing and used as holding members.

In all of the embodiment examples according to FIGS. 1 to 11 described above, all of the respective supports 18 to 21; 118 to 121; 218 to 221; 318 to 321 which are formed in a longitudinally extending ridge 23; 123; 223; 323 by recesses 24 to 27; 124 to 127; 224 to 227; 324 to 327 project inward and above the inner surface 14; 114; 214; 314 of the shaft element 11; 111; 211; 311. Each shaft element 11; 111; 211; 311 is accordingly thickened internally at this location. The cross-sectional thickness of the wall 13; 113; 213; 313 is also of exactly the same magnitude as the remaining circumference in this region with the exception of the inwardly projecting ridge 23; 123; 223; 323. Together with its foot crosspieces 28 to 31; 128 to 131; 228 to 231; 328 to 331, the respective ridge 23; 123; 223; 323 accordingly forms a kind of ladder whose rungs are formed by the aforementioned foot crosspieces and whose cross beams are formed on either side by the longitudinally extending walls of the ridge 23; 123; 223; 323. A ladder designed in this way increases the sense of security of the person having to enter the shaft assembled from such shaft elements. The outer surfaces of the wall parts of the ridge 23; 123; 223; 323 situated on the outside can be utilized in addition for grasping and as a support when climbing. This is true in a particularly advantageous manner primarily for the second embodiment example in which the recesses 124 to 127, insofar as they extend above the foot crosspieces 128 to 131, have very large dimensions in the vertical direction and accordingly offer abundant free space so that the outer walls 138, 139 and also the center wall 140 of the ridge 123 extending therebetween can be securely grasped when climbing this ladder formation.

In an embodiment example which is not shown in the drawing, the walls defining the ridges 23; 123; 223; 323, e.g. in the case of ridge 123, the outer walls 138, 139 and center wall 140, are designed so as to be broader in the horizontal direction than is shown in the drawing. These walls, e.g. the outer walls 138, 139 and the center wall 140, project farther inward beyond the foot crosspieces 28 to 31; 128 to 131; 228 to 231; 328 to 331. This projecting part, which extends so as to be continuous in the longitudinal direction correspondingly following the longitudinal course of the respective ridge 23; 123; 223; 323, can accordingly be gripped more easily when climbing this ladder-like formation and can be used to a certain extent as a handrail. Accordingly, the ridge 23; 123; 223; 323 has gripping parts at its outer side which can be grasped by the hand. These gripping parts are constructed as handrail strips which project from the outer sides of the ridge 23; 123; 223; 323 and e.g. extend longitudinally in a continuous manner and are formed so as to be integral with the ridge 23; 123; 223; 323.

Figure 12:
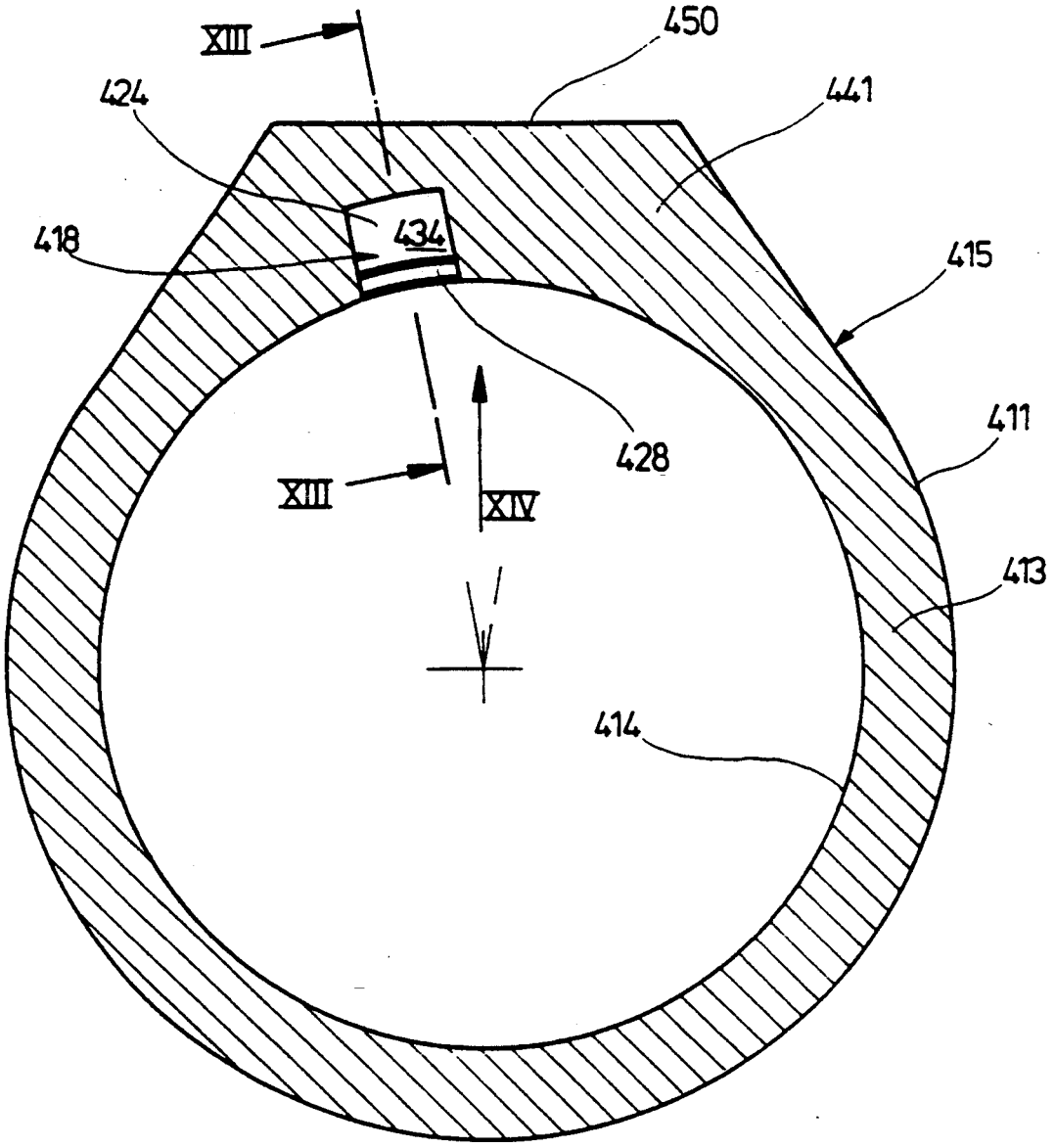
FIG. 12 shows a schematic horizontal section of an upended shaft element according to a fifth embodiment example.
Figure 13:
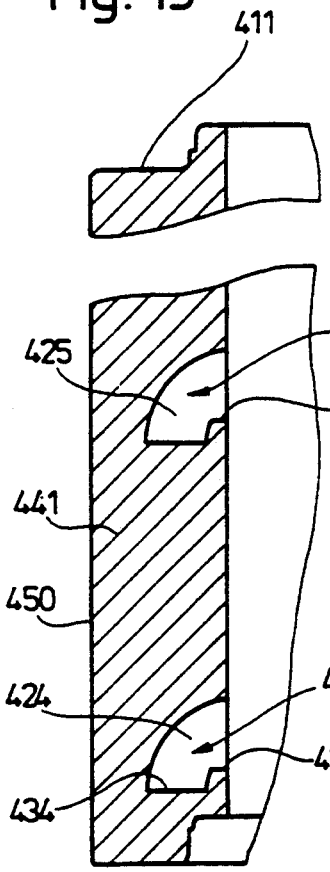
FIG. 13 shows a section along the line XIII—XIII in FIG. 12.
Figure 14:
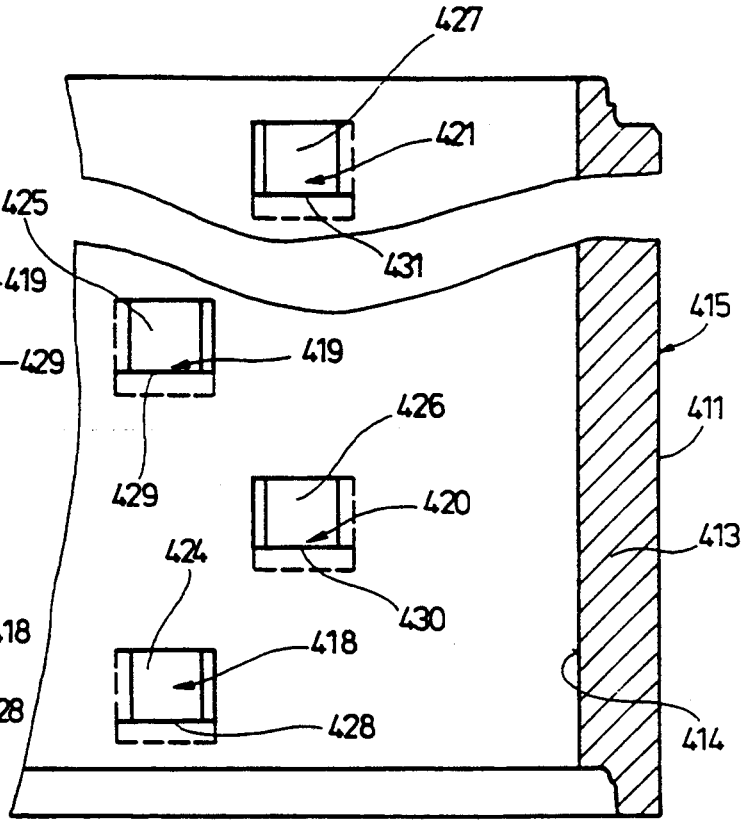
FIG. 14 shows a schematic side view in partial section in the direction of arrow XIV in FIG. 12.

In the fifth embodiment example in FIGS. 12 to 14, the supports 418 to 421 are arranged in double formation so as to be offset relative to one another in a manner similar e.g. to the first embodiment example in FIGS. 1 to 3, particularly the recesses 424 to 427 with foot crosspieces 428 to 341. The fifth embodiment example differs from the preceding embodiment examples in that the support 418 to 421, of which there is at least one, is recessed into the wall 413 of the shaft element 411, i.e. it does not project inward over the inner surface 414. In so doing, each support 418 to 421 extends within the wall 413 proceeding from its inner surface 414 in the direction of its outer surface 415. As shown in FIG. 12, each recess 424 to 427 is arranged in such a way that its vertical plane of symmetry coincides with a radial plane, as is also the case in the first embodiment example. The shaft element 411 is weakened in cross section by the inner recesses 424 to 427 inserted into the wall 413. For this reason, the shaft element 411 has a thickened wall portion 441 in the region where the supports 418 to 421 are inserted in the wall 413. This thickened wall portion 441 is constructed, for example, so as to be substantially longitudinally continuous and e.g. directed outward. As shown especially in FIG. 12, the outer surface of the thickened wall portion 441 diverges from the round shape of the outer surface 415. It is planar. The cross section of the wall 413 increases steadily in the transitional region from this round outer surface 415 to the planar outer surface of the thickened wall portion 441. The reduced cross section caused by the supports 418 to 421 inserted in the wall 413 is compensated for by this thickened wall portion 441.

Another peculiarity of the fifth embodiment example in FIGS. 12 to 14 consists in that the foot crosspieces 428 to 431 do not extend in a straight line, but rather curve in an arch-shaped manner, this curvature being contiguous to that of the inner surface 414.

A further particularity of the fifth embodiment example consists in that the individual recesses 424 to 427 extend in a roughly arch-shaped manner as viewed in vertical cross section according to FIG. 13. All of them terminate in an approximately horizontal and planar base 434 as shown in recess 424. In comparison to the first four embodiment examples, in which the recesses are constructed in a roughly quadrangular, e.g. rectangular or square shape, as seen in vertical cross section, the arch-shaped curvature of the recesses 424 to 427 convey a different impression. This shape facilitates the mold insertion. As a result, each recess 424 to 427, as seen in vertical section according to FIG. 13, extends outward proceeding from the foot crosspiece 428 to 431, i.e. in the direction of the outer side of the thickened wall portion 441, and downward. Accordingly, the end wall which, as in the first four embodiment examples, defines the interior of the recess and is directed approximately at a right angle to the upper wall of the recess is absent in this elbow shape of the recesses 424 to 427 in which the upper wall and the end wall are merge in the elbow shape to form an inner arch-shaped surface which curves from the inner surface 414 to the base 434 and is situated at a distance above the foot crosspiece 428 to 431.

Figure 15:
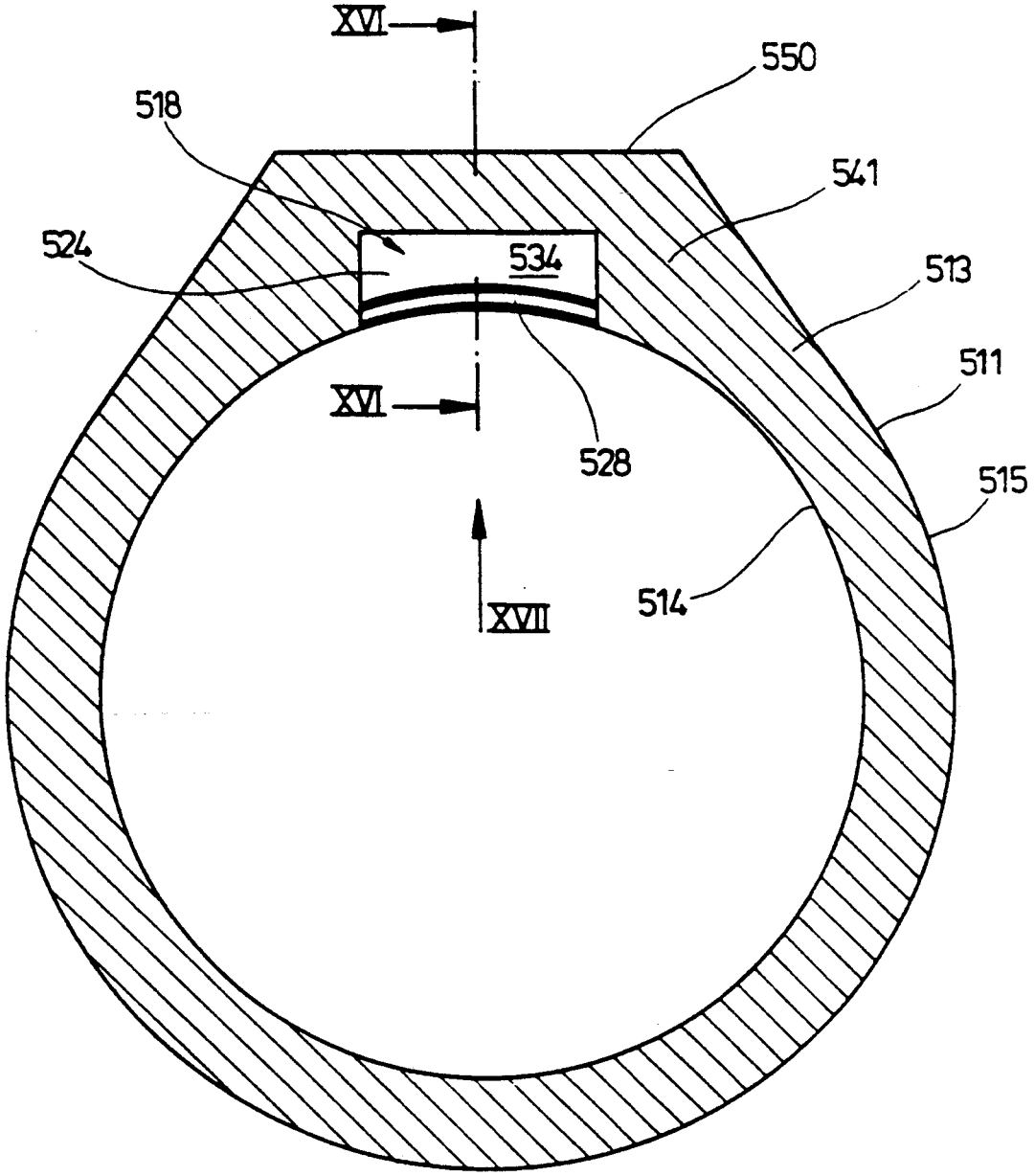
FIG. 15 shows a schematic horizontal section of an upended shaft element according to a sixth embodiment example.
Figure 16:
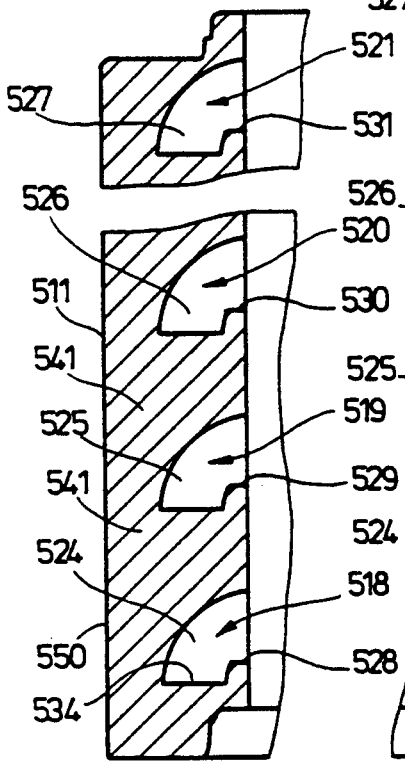
FIG. 16 shows a schematic section along the line XVI—XVI in FIG. 15.
Figure 17:
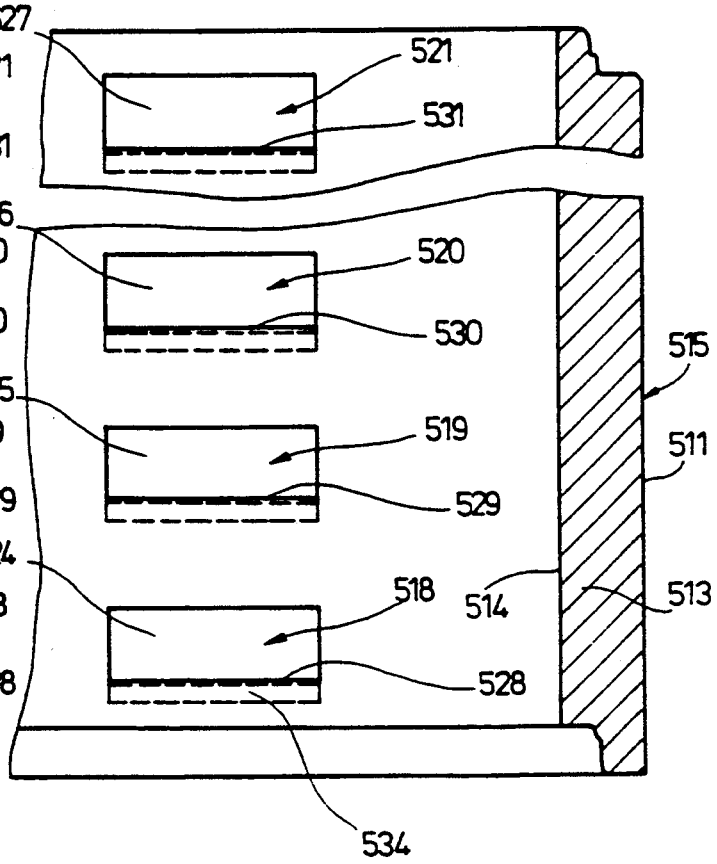
FIG. 17 shows a schematic side view in partial section in the direction of arrow XVII in FIG. 15.

The sixth embodiment example shown in FIGS. 15 to 17 is similar to the fourth embodiment example in FIGS. 9 to 11 with respect to the arrangement of the supports 518 to 521 as the supports 518 to 521 are also arranged one above the other in single formation in the sixth embodiment example. Like the fifth embodiment example, these supports 518 to 521 are also inserted in the wall 513 of the shaft element 511 in the sixth embodiment example, the resulting loss in cross section of the wall 513 being compensated for by a thickened wall portion 541. The cross section of the shaft element 511 corresponds to that of the shaft element 411 of the fifth embodiment example. The recesses 524 to 527 with the foot crosspiece 528 to 531 also correspond in horizontal and vertical section to the design according to FIGS. 12 to 14. To this extent the description referring to the fifth embodiment example relates in a corresponding sense to the sixth embodiment example. However, in comparison to the fifth embodiment example, the recesses 524 to 527 in the sixth embodiment example in FIGS. 15 to 17 are dimensioned so as to be wider as seen in horizontal cross section. As a result, the foot crosspieces 523 to 531 extend over a greater circumferential angle of curvature of the inner surface 514, i.e. they are wider. This greater width makes it possible, if necessary, to use the upwardly projecting foot crosspieces 528 to 531 as handles when climbing a shaft designed in this way, as has already been described for the other corresponding embodiment examples. These foot crosspieces 528 to 531 are also well-suited for grasping with the hand precisely because they project upward beyond the base of the recess 524 to 527 and form ledges.

Figure 18:
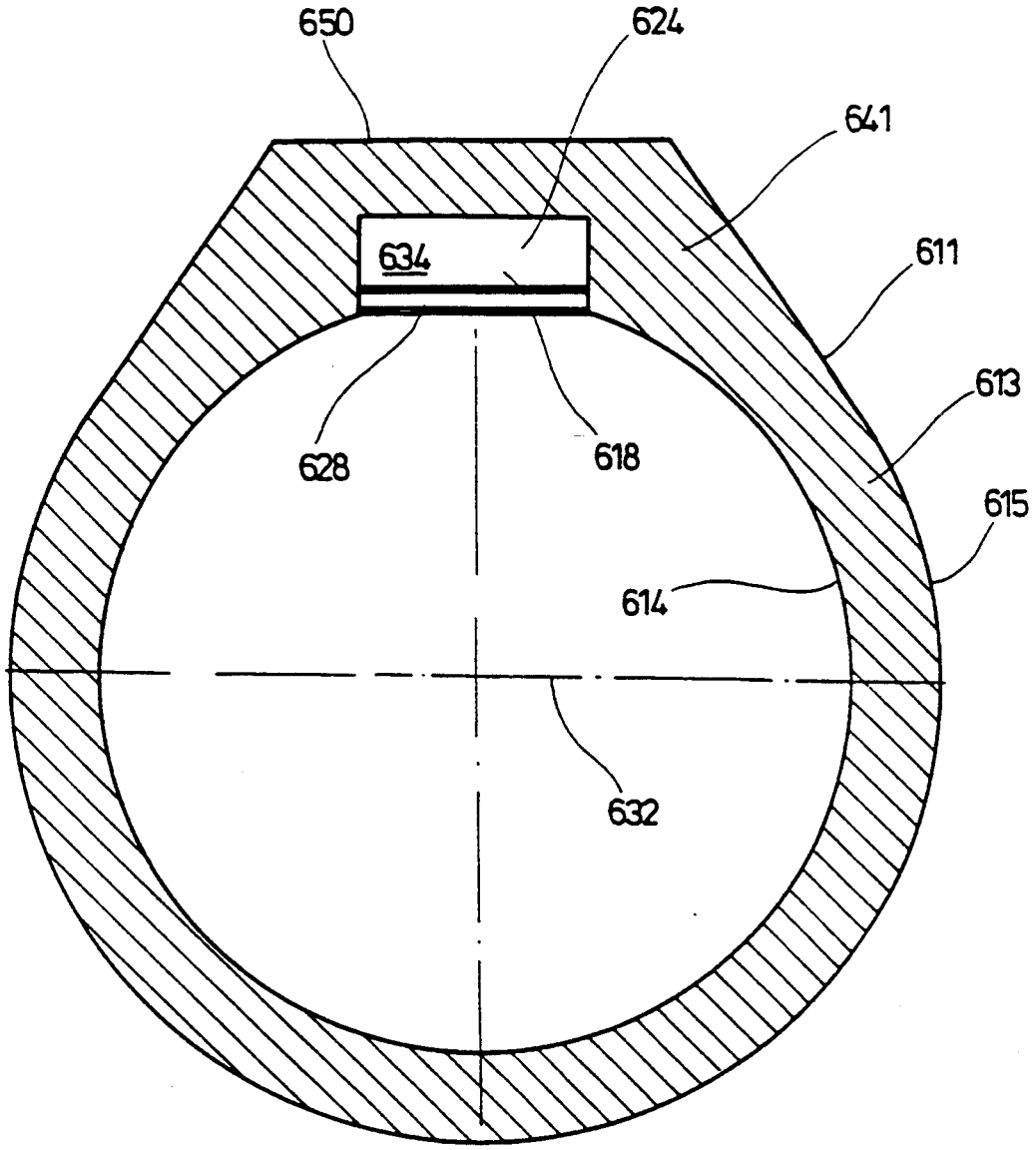
FIG. 18 shows a schematic horizontal section of an upended shaft element according to a seventh embodiment example.

The seventh embodiment example shown in FIG. 18 corresponds to the sixth embodiment example according to FIGS. 15 to 17 with respect to the design of the shaft element 611. One difference in the case of the support 618, the only one visible in the drawing, which is formed from a recess 624 inserted in the wall 613 of the shaft element 611, consists in that the approximately horizontal foot crosspiece 628 projecting up over the base is not constructed so as to curve in an arch-shaped manner as seen in horizontal cross section as in the sixth embodiment example, but rather extends approximately along a secant or roughly parallel to a vertical diametral plane 632 of the shaft element 611 and accordingly e.g. in the same way as every foot crosspiece 328 to 331 in the fourth embodiment example.

Figure 19:
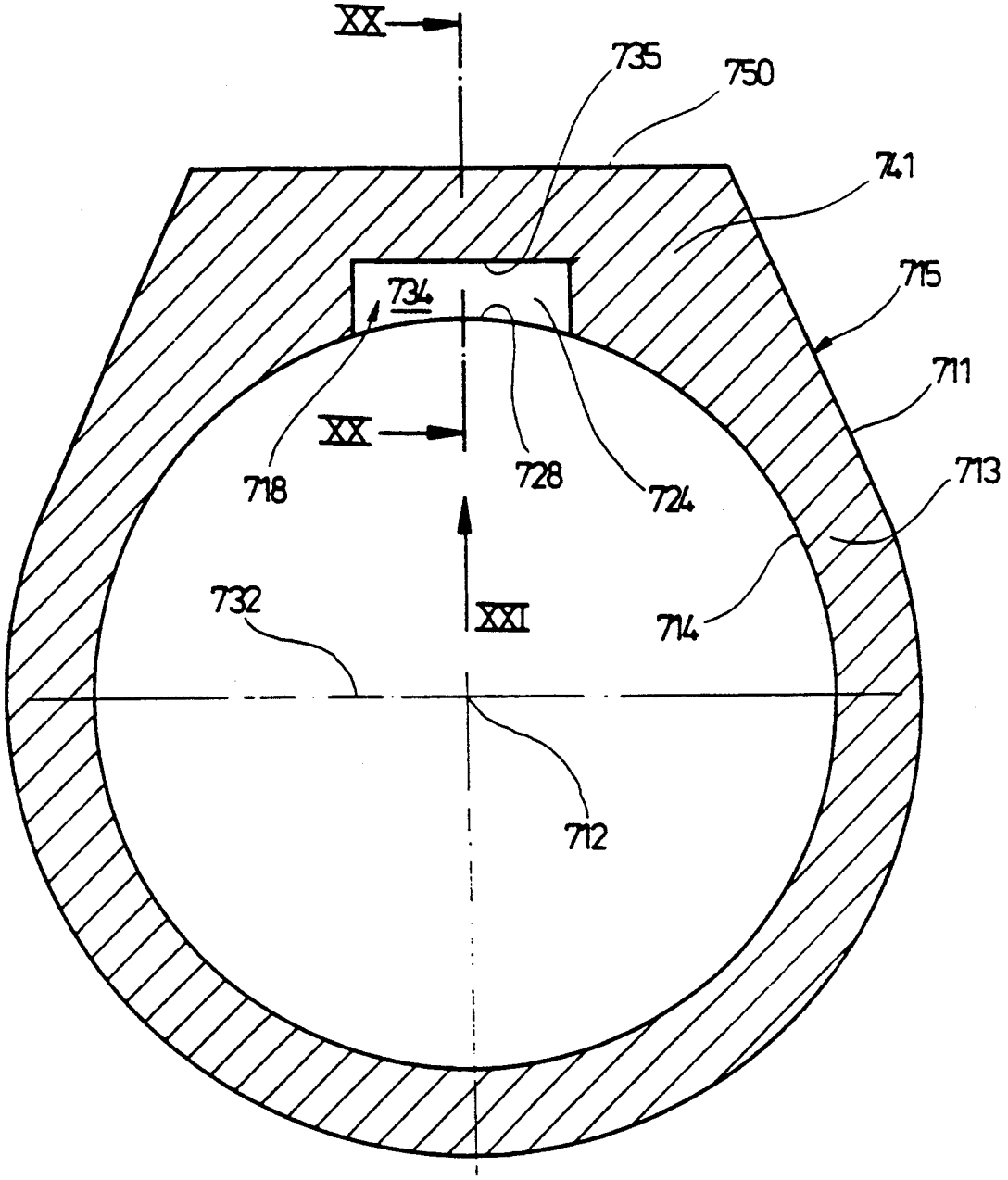
FIG. 19 shows a schematic horizontal section of an upended shaft element according to an eighth embodiment example.
Figure 20:
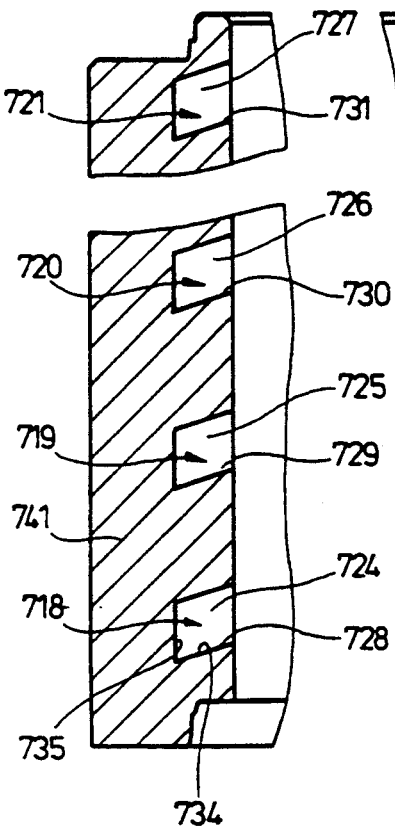
FIG. 20 shows a schematic section along line XX—XX in FIG. 19.
Figure 21:
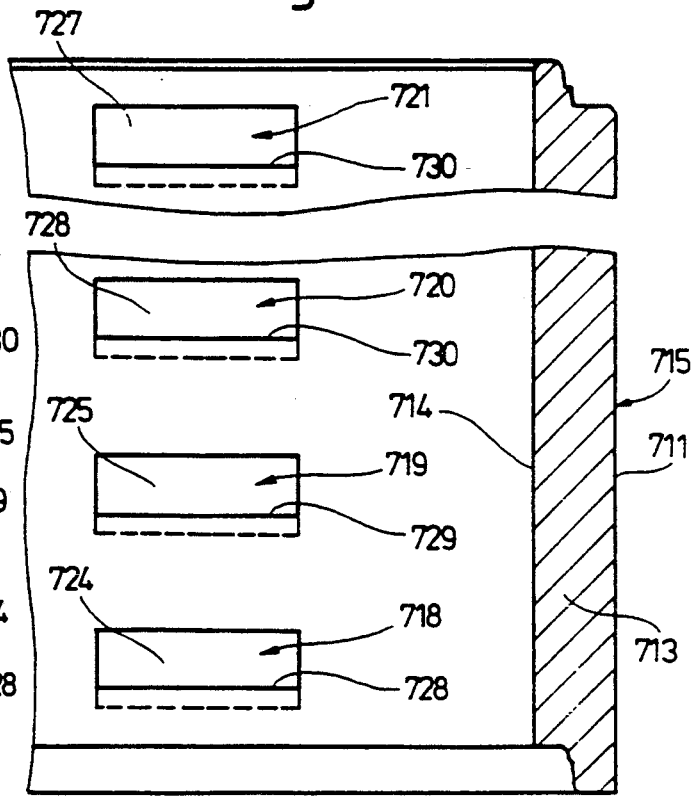
FIG. 21 shows a schematic side view in partial section in the direction of arrow XXI in FIG. 19.

In the eighth embodiment example shown in FIGS. 19 to 21, every support 718 to 721 is likewise constructed as a recess 724 to 727 which is inserted in the wall 713 of the shaft element 711 and has a vertically projecting foot crosspiece 728 to 731. Moreover, in a manner analogous e.g. to the sixth embodiment example, the supports 718 to 721 are arranged one above the other in single formation. Every recess 724 to 727 is a quadrangle as seen in horizontal cross section, particularly rectangular, which also corresponds to the sixth embodiment example. As seen in horizontal cross section, every foot crosspiece 728 to 731 extends in an arch-shaped curve as in the sixth embodiment example, the curvature corresponding to that of the inner surface 714. In contrast to the sixth embodiment example, however, the recesses 724 to 727 are constructed in an approximately rhombic shape as seen in vertical cross section. As shown exclusively by way of the recess 724, the end wall 735 defining the interior of the recess 724 extends approximately parallel to the vertical diametral plane 732 containing the center line 712. As shown in the recess 724, the base 734 of each recess extends outward proceeding from the foot crosspiece 728 and downward in a sloping manner as seen in vertical cross section. The base 734 and the end wall 735 extend at an angle of less than 90° relative to one another. The upper wall defining the recess 724 at the top extends approximately parallel to the base 734. This design of the recesses 724 to 727 results in foot crosspieces 728 to 731 which e.g. are constructed so as to be slightly knife-shaped. This can be beneficial for gripping when climbing.

Figure 22:
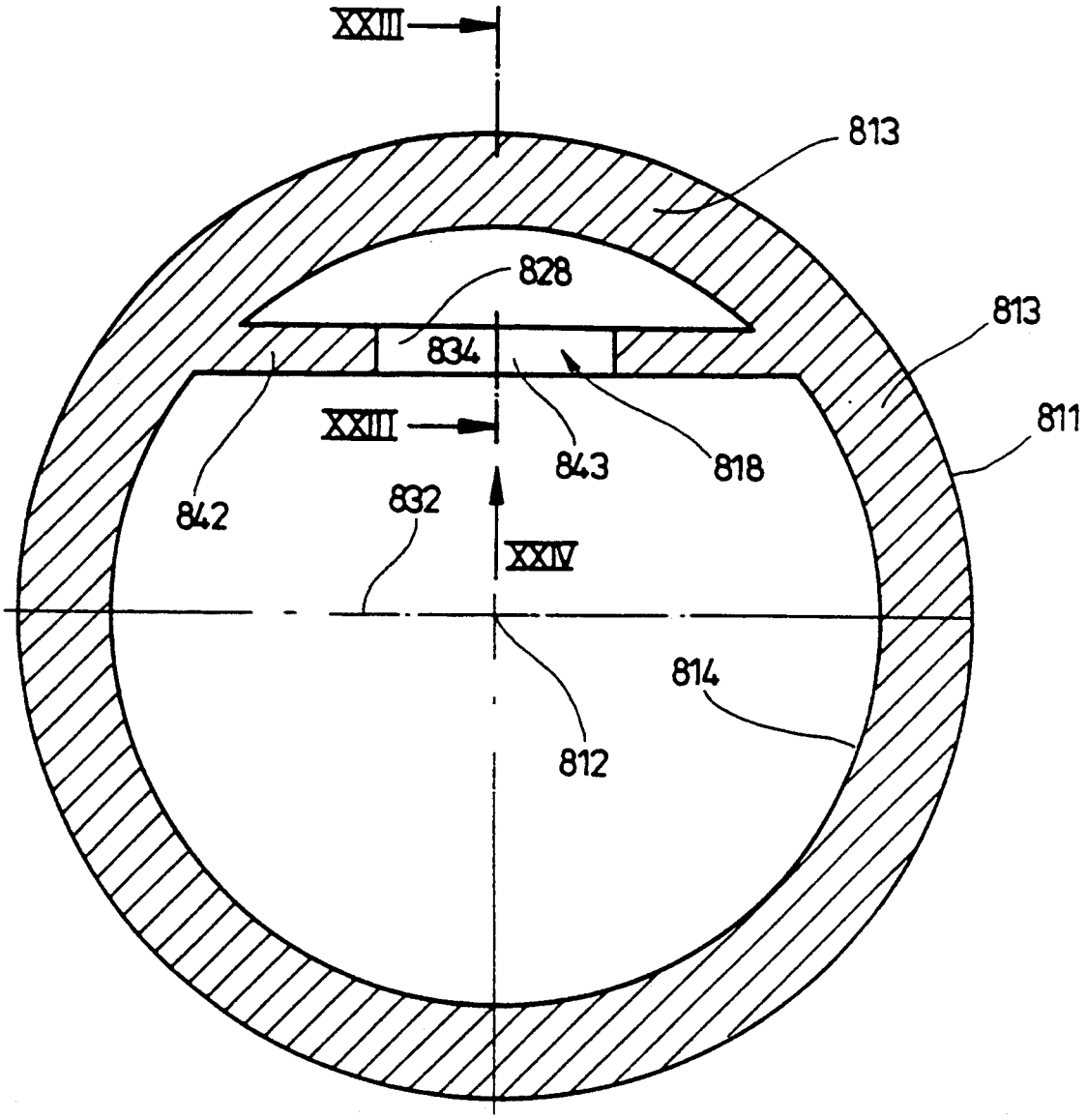
FIG. 22 shows a schematic horizontal section of an upended shaft element according to a ninth embodiment example.
Figure 23:
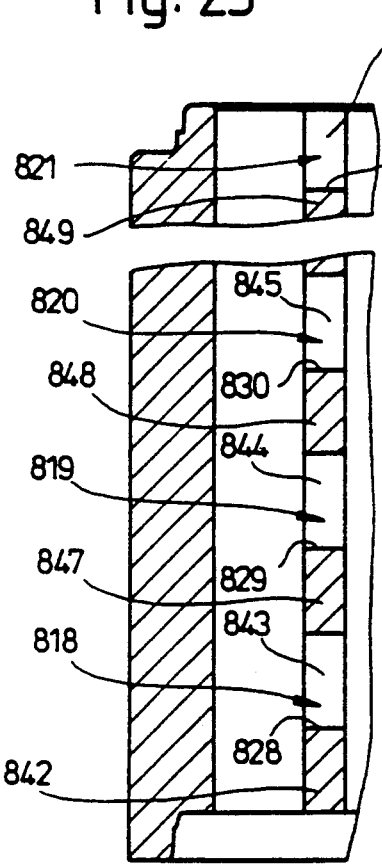
FIG. 23 shows a schematic section along line XXIII—XXIII in FIG. 22.
Figure 24:
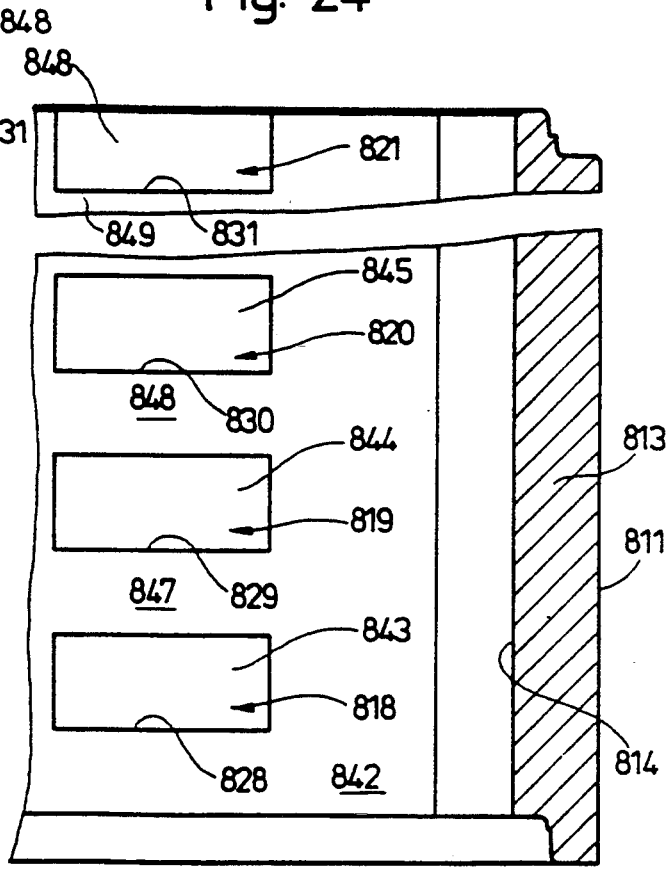
FIG. 24 shows a schematic side view in partial section in the direction of arrow XXIV in FIG. 22.

In the ninth embodiment example according to FIGS. 22 to 24, the supports 818 to 821 are also integral components of the shaft element 811, being uniform with the latter in terms of material, and are molded together with the shaft element from the same molding material. These supports 818 to 821 also project inward over the inner surface 814 of the shaft element 811 in this instance. In contrast to the embodiment examples in FIGS. 1 to 11, however, these supports 818 to 821 are constructed in an intermediate wall 842 of the shaft element 811 in the ninth embodiment example. The intermediate wall 842 extends approximately along a secant. It extends roughly parallel to the vertical diametral plane 832 of the shaft element 811 containing the center line 812. The intermediate wall 842 thus extends at a distance from the circumferential part of the inner surface 814 covered by the intermediate wall 842. To form the supports 818 to 821 in the single formation shown in the drawing or also in double formation, not shown, the intermediate wall 842 contains recesses, particularly openings 843 to 846, constructed e.g. as windows which are rectangular as seen in horizontal and vertical section. The supports 818 to 821 are accordingly contained within the intermediate wall 842 in this construction. However, in another embodiment example which is not shown in the drawing it is also possible for the supports to be arranged, e.g. inserted, so as to project inwardly at the intermediate wall 842, e.g. analogous to the first four embodiment examples, or so as to project outward radially as in embodiment examples four to eight. In this construction, the material ridges 847 to 849 of the intermediate wall 842 which are located between the individual openings 843 to 846 can be grasped by the hand so as to provide support when climbing the ladder formation designed in this way.

Figure 25:
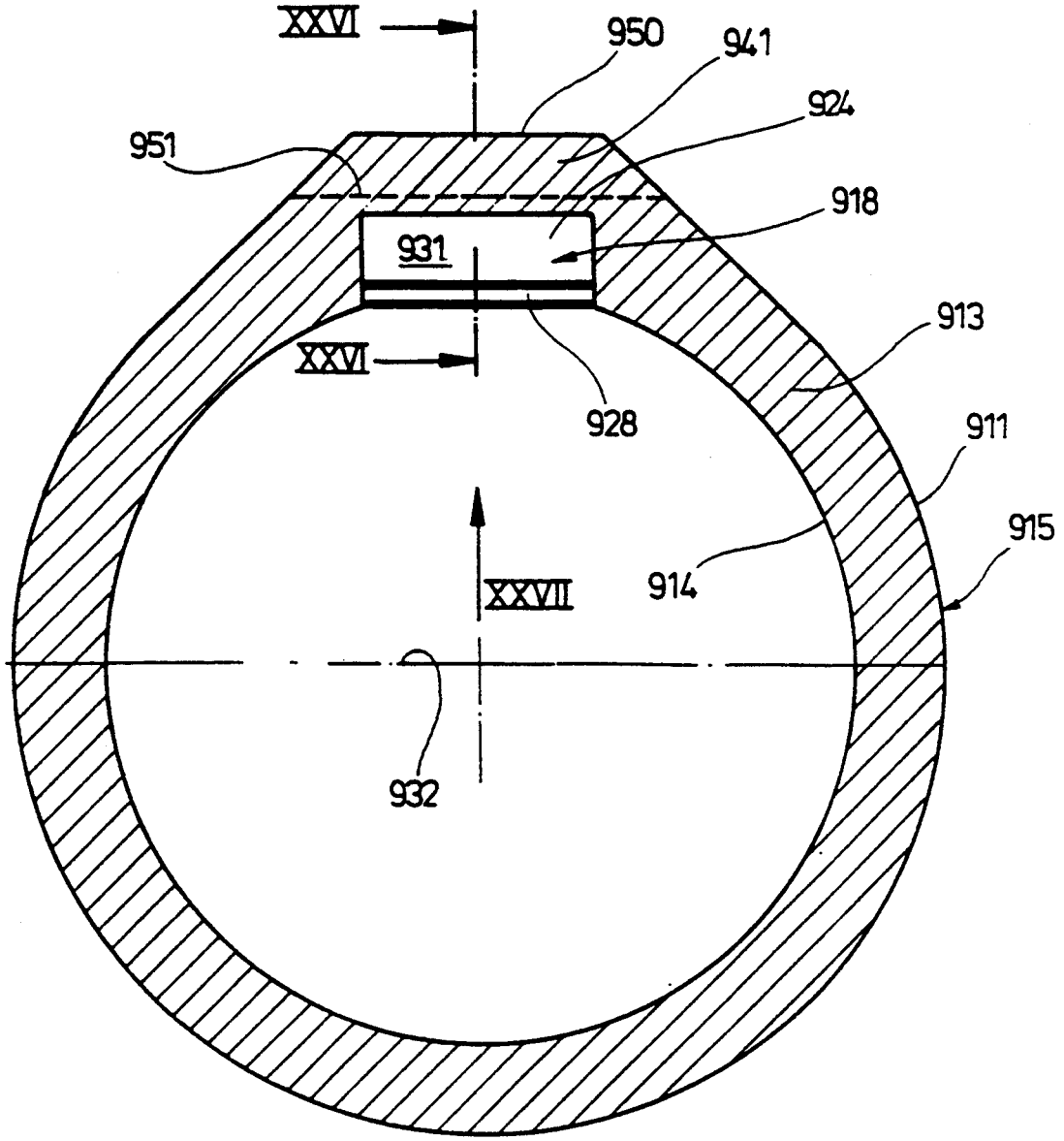
FIG. 25 shows a schematic horizontal section of an upended shaft element according to a tenth embodiment example.
Figure 26:
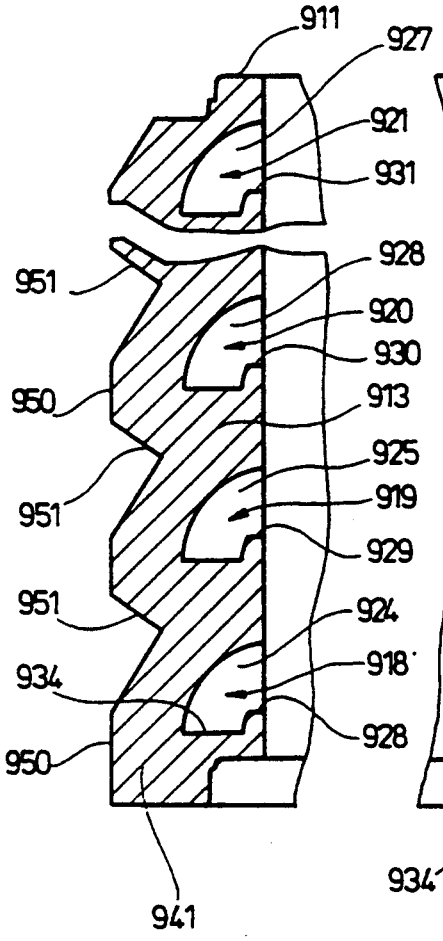
FIG. 26 shows a schematic section along line XXVI—XXVI in FIG. 25.
Figure 27:
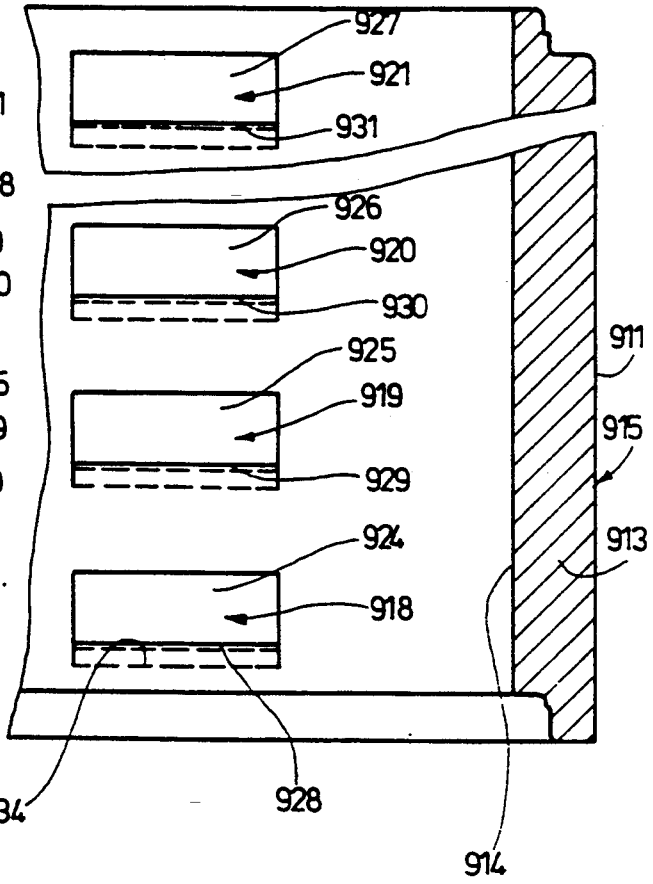
FIG. 27 shows a schematic side view in partial section in the direction of arrow XXVII in FIG. 25.

The tenth embodiment example shown in FIGS. 25 to 27 corresponds to the sixth embodiment example according to FIGS. 15 to 17 e.g. with respect to the construction of the supports 918 to 921 which are inserted into the wall 913 of the shaft element 911 as recesses 924 to 927 and have upright foot crosspieces 928 to 931. The foot crosspieces 928 to 931 extend approximately parallel to the vertical diametral plane 932 similar to the seventh embodiment example. The principle in the tenth embodiment example relates not to the design of the supports 918 to 921, but to the peculiarity that the thickened wall portion 941 provided for compensating for the weakened cross section caused by the recesses 924 to 927 inserted in the wall 913 has cut out portions 951 which open outward in the region of the outer surface 950 for reducing the amount of material consumed and for economizing on weight. It is particularly advantageous that these cut out portions 951 are provided vertically between two inner recesses 918 and 919; 919 and 920; 920 and 921 which are arranged vertically one above the other as shown in FIG. 26. As can be seen in the intermediate area between two successive recesses in the thickened wall portion 941, at least in the external region, a corresponding quantity of material in the shaft element 911, particularly concrete, is not absolutely necessary so that material and weight can be saved in this region by cut out portions 951. The depth of the cut out portions 951 is determined by the minimum residual cross section for a given minimum wall thickness. In principle, the shape of the cut out portions 951 is not of decisive importance. It can be selected in such a way that a maximum saving of weight and material is achieved while maintaining the required minimum wall thickness.

Figure 28:
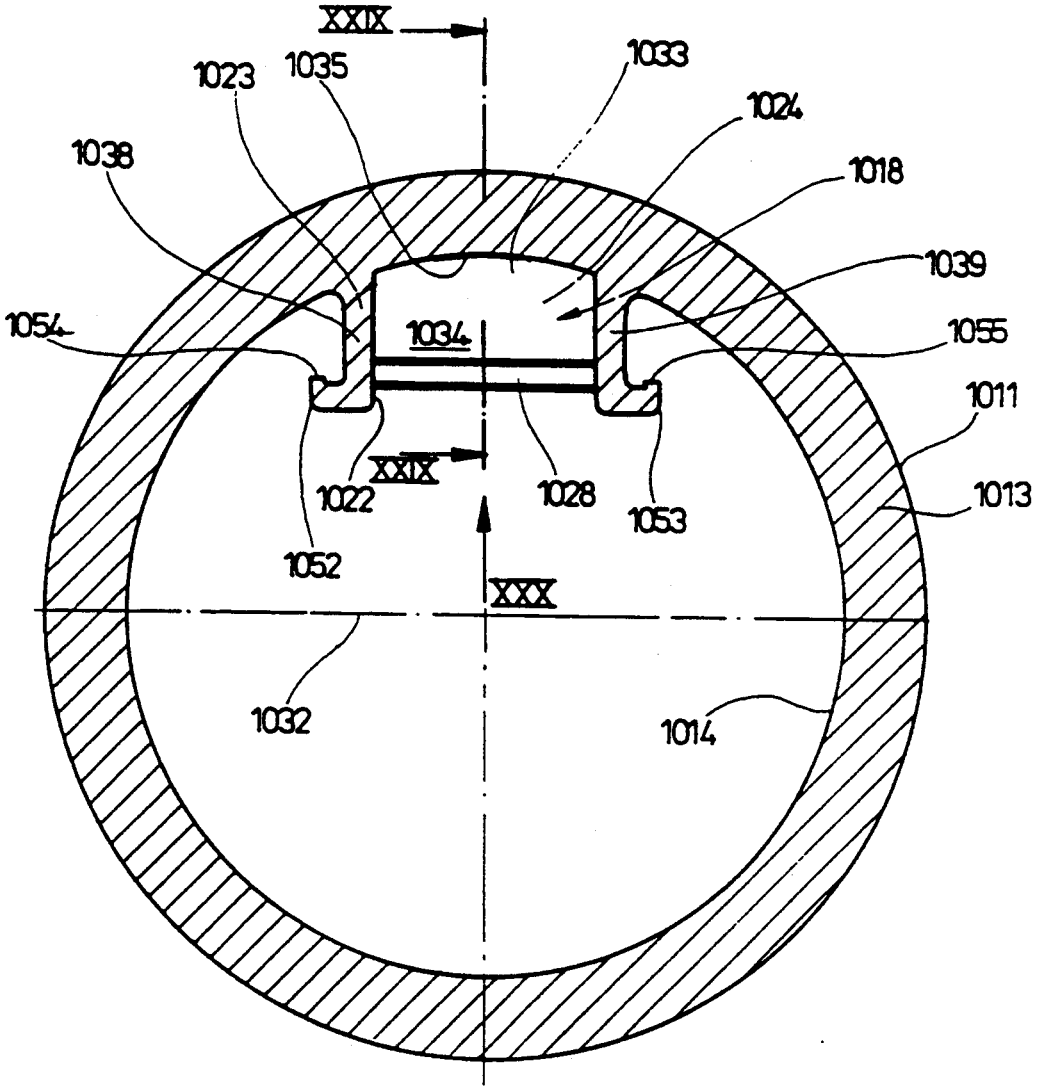
FIG. 28 shows a schematic horizontal section of an upended shaft element according to an eleventh embodiment example.
Figure 29:
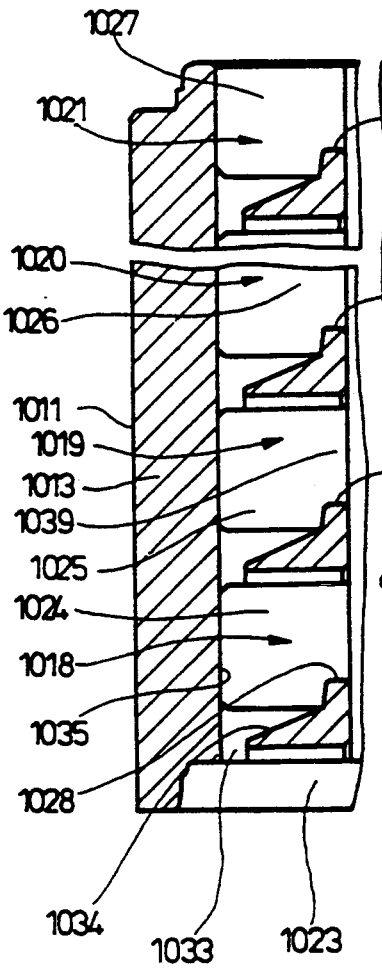
FIG. 29 shows a schematic section along line XXIX—XXIX in FIG. 28.
Figure 30:
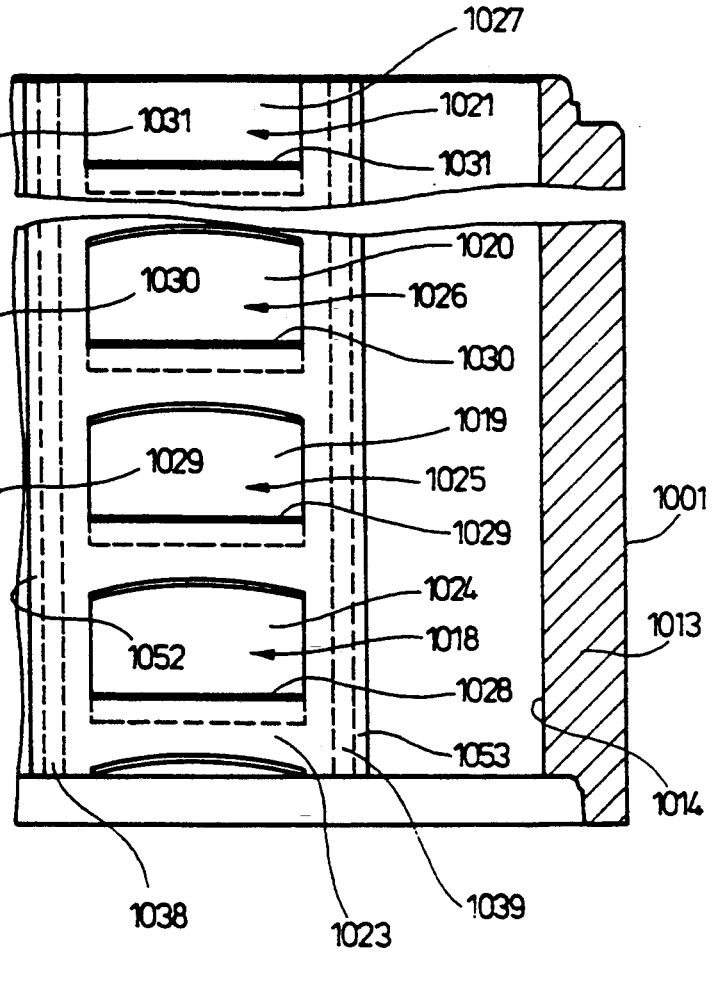
FIG. 30 shows a schematic side view in partial section in the direction of arrow XXX in FIG. 28.

The eleventh embodiment example shown in FIGS. 28 to 30 is similar to the first four embodiment examples, specifically in that the supports 1018 to 1021 are also constructed in the eleventh embodiment example as recesses 1024 to 1027 which are inserted in a longitudinally continuous ridge 1023, project inwardly over the inner surface 1014 toward the center, and have vertically projecting foot crosspieces 1028 to 1031. These supports are arranged one above the other in single formation, e.g. roughly analogous to the fourth embodiment example. The ridge 1023 has two outer walls 1038, 1039 on both sides which are aligned roughly at a right angle to the vertical diametral plane 1032. The ridge 1023 has gripping parts 1052; 1053 at its outer side, particularly at the outer side of the outer walls 1038, 1039 which faces radially inward, which gripping parts 1052 and 1053 can be grasped with the hand. These gripping parts 1052, 1053 are constructed in this instance as longitudinally continuous handrail strips which are situated at the outer sides of the ridge 1023, particularly at its outer walls 1038, 1039, and are formed so as to be integral with the ridge 1023. These gripping parts 1052, 1053 which are constructed as longitudinally continuous handrail strips extend roughly at right angles to the outer wall 1039 and 1039 and approximately parallel to the vertical diametral plane 1032. This results in an angular shape in cross section between the outer wall 1038 and the gripping part 1052 in the form of the continuous handrail strip which is integral with the latter. This applies in a corresponding sense to the outer wall 1039 and the gripping part 1053 integral with it. Also, every gripping part 1052, 1053 is provided with a bead 1054; 1055 which projects over the rear surface of the gripping part 1052; 1053 in the direction of the inner surface 1014 and extends at least approximately parallel to the outer wall 1038; 1039. The bead 1054, 1055 not only contributes to a material reinforcement, but every gripping part 1052, 1053, together with this bead 1054; 1055 forms a particularly convenient handrail which is easy to grasp with the hand when climbing the ladder-shaped formation formed by the supports 1018 to 1021, which further increases safety when entering and climbing this ladder-shaped formation. The cost of adding the gripping parts 1052, 1053 with the bead 1054; 1055 is low in comparison to the achieved improvement.

As is shown in FIG. 30, in contrast to the previous embodiment forms, the upper wall terminating the recess 1024 to 1027 at the top extends in a slightly arch-shaped manner, specifically so as to curve upward in a convex manner. Another peculiarity consists in that the base 1034, indicated exclusively by recess 1024, slopes outward in the radial direction proceeding from the foot crosspiece 1028 and downward along an inclined surface which is also the case e.g. with respect to the base in the eighth embodiment example. However, the base 1034 is not connected to the wall 1013 at its lowest point. Rather, a passage 1033 which opens downward and is shaped roughly like a slot in this instance is formed in the base 1034 and extends along the entire width of the foot crosspiece 1028. The advantage of the sloping base 1034 consists in that liquids, impurities or the like which may settle on the base 1034 slide to the rear as a result of the inclination and are rinsed to the rear and then flow down through the passage 1033 so that a particularly good self-cleaning of the recesses 1024 to 1027 is effected in this base region.

Figure 31:
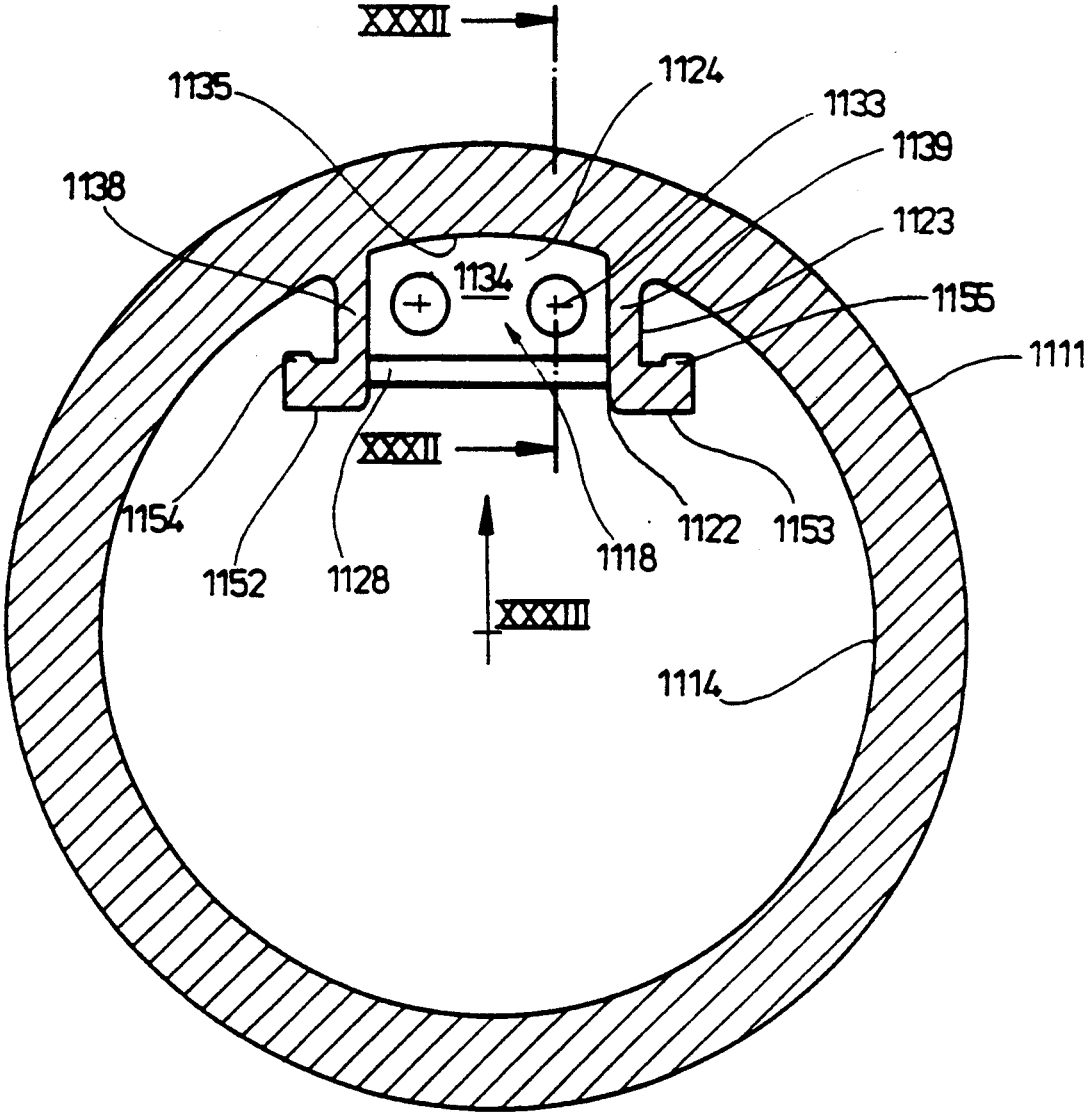
FIG. 31 shows a schematic horizontal section of an upended shaft element according to a twelfth embodiment example.
Figure 32:
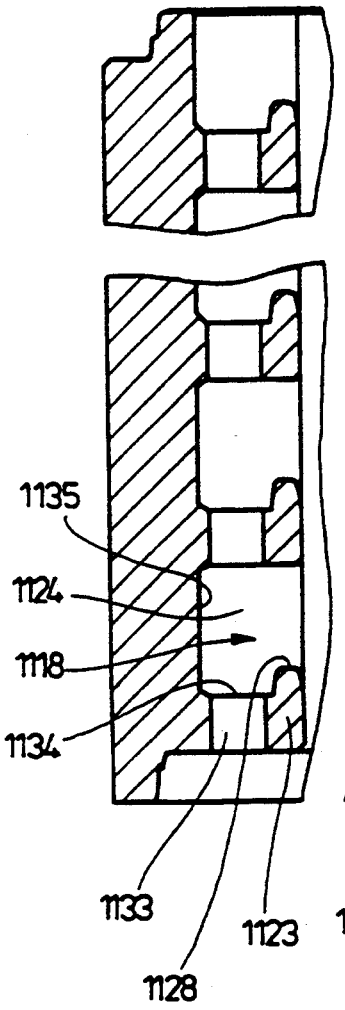
FIG. 32 shows a schematic section along line XXXII—XXXII in FIG. 31.
Figure 33:
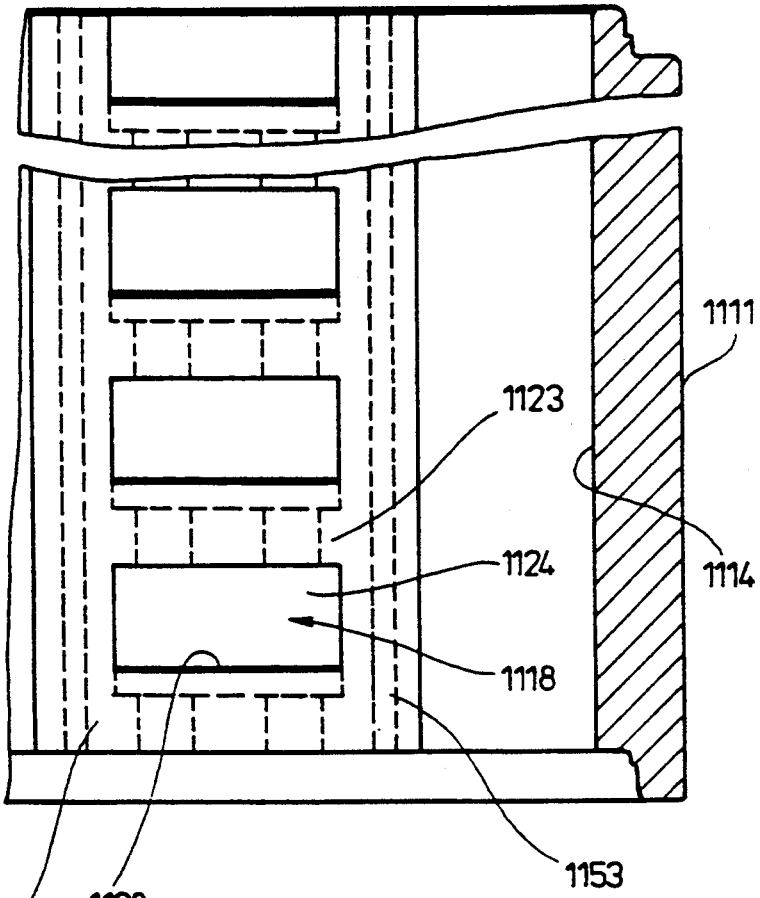
FIG. 33 shows a schematic side view in partial section in the direction of arrow XXXIII in FIG. 31.

The twelfth embodiment example shown in FIGS. 31 to 33 corresponds to the fourth embodiment example in FIGS. 9 to 11, the only difference being that the ridge 123 in the twelfth embodiment example is provided at the outer side of the outer walls 1138, 1139 with gripping parts 1152, 1153 and a bead 1154; 1155 and the handrails formed by the latter in a manner similar to the eleventh embodiment example in FIGS. 28 to 30.

It will be understood that each of the elements described above, or two or more together, may also find a useful application in other types of constructions differing from the types described above.

While the invention has been illustrated and described as embodied in a shaft element made from molding material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said support being formed as a recess having a considerable width.

2. A shaft element as defined in claim 1, wherein said extension is formed as a thickened wall portion of said shaft member.

3. As defined in claim 2, wherein said thickened wall portion is formed as in inner thickened wall portion of said shaft member.

4. As defined in claim 3, wherein said inner thickened wall portion is formed as a ridge extending substantially longitudinally of said shaft member along an inner surface line of the latter.

5. As defined in claim 1, wherein said extension is formed as an internal intermediate wall of said shaft member.

6. As defined in claim 5, wherein said support is formed at said intermediate wall of said shaft member.

7. As defined in claim 5, wherein said support is formed in said intermediate wall of said shaft member.

8. As defined in claim 5, wherein said intermediate wall extends substantially parallel to a vertical diametrical plane of said shaft member.

9. As defined in claim 5, wherein said intermediate wall extends at a distance from a part of an inner surface of said shaft member covered by said intermediate wall.

10. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said thickened wall portion being formed as in inner thickened wall portion of said shaft member, said inner thickened wall portion being formed as a ridge extending substantially longitudinally of said shaft member along an inner surface line of the latter, said ridge having gripping parts formed at an outer side of the ridge and graspable by hand.

11. As defined in claim 10, wherein said gripping parts are formed as handrail grips provided on the outer side of said ridge and formed integral with said ridge.

12. As defined in claim 11, wherein said handrail grips project out transversely of said ridge and are longitudinally continuous.

13. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said support being formed as a recess provided inside a wall of shaft element in the region of said thickened wall portion.

14. As defined in claim 13, wherein said thickened wall portion of said shaft member is directed outwardly.

15. As defined in claim 14, wherein said thickened wall portion of said shaft member is substantially longitudinally continuous.

16. As defined in claim 14, wherein said thickened wall portion of said shaft member has cut out portions which open outwards.

17. As defined in claim 16, wherein said cutout portions are located vertically between two inner recesses arranged vertically one above the other.

18. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said support being formed as a recess having a foot cross piece adjoining an inner surface of said extension, said foot cross piece projecting upwardly, extending substantially horizontally and being grippable with a hand.

19. As defined in claim 18, wherein said foot cross piece has a substantially planar upper side.

20. As defined in claim 19, wherein said planer upper side of said foot cross piece is textured.

21. As defined in claim 18, wherein said foot cross piece extends in a straight line.

22. As defined in claim 18, wherein said foot cross piece curves in an arch-shaped manner.

23. As defined in claim 18, wherein said support is formed as a substantially box-shaped recess as seen in at least one of a horizontal and vertical cross section.

24. As defined in claim 23, wherein said recess is substantially box-shaped in both said horizontal and vertical cross sections.

25. As defined in claim 23, wherein said recess has a base which extends substantially horizontally.

26. As defined in claim 23, wherein said recess has a base which extends outwardly and downwardly proceeding from said foot cross piece.

27. As defined in claim 18, wherein said recess has an interior defined by an end wall which extends in substantially curved manner as seen in a horizontal cross section.

28. As defined in claim 18, wherein said recess has an interior defined by an end wall which extends substantially in a straight line as seen in a horizontal cross section.

29. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said thickened wall portion being formed as in inner thickened wall portion of said shaft member, said inner thickened wall portion being formed as a ridge extending substantially longitudinally of said shaft member along an inner surface line of the latter, said ridge having a substantial width, said support being formed by a recess in an interior of said ridge.

30. As defined in claim 29, wherein said support is provided with a coat of paint.

31. As defined in claim 30, wherein said coat of paint is a protective coating.

32. As defined in 30, wherein said coat of paint is a corrosion-protective coating.

33. As defined in claim 30, wherein said coat of paint has an identifying color.

34. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said extension being formed as an internal intermediate wall of said shaft member, said intermediate wall extending approximately along a secant of said shaft member.

35. A shaft element as defined in claim 29, wherein said shaft member is composed of concrete with a water-cement ratio of at most 0.4.

36. A shaft element as defined in claim 29, wherein said shaft member is composed of compacted material.

37. A shaft element as defined in claim 29, wherein said shaft member is composed of vibro-compacted material.

38. A shaft element as defined in claim 29, wherein said shaft member is composed of a material shaped by compaction with subsequent immediate release from a compacting mold.

39. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said thickened wall portion being formed as in inner thickened wall portion of said shaft member, said inner thickened wall portion being formed as a ridge extending substantially longitudinally of said shaft member along an inner surface line of the latter, said ridge having substantially a shape of a longitudinal ledge.

40. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said extension being formed as an internal intermediate wall of said shaft member, said intermediate wall having at least one recess forming said support.

41. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said extension being formed as a thickened wall portion of said shaft member, said intermediate wall being provided with a plurality of recessed arranged in pairs to form a plurality of said supports.

42. A shaft element composed of molding material, comprising a shaft member having a hollow interior; at least one support provided in said interior of said shaft member so that a person can step on said support, said support being an integral component part of said shaft member, said shaft member having an extension, said support being formed in the region of said extension; and at least one additional such support, said supports being formed as recesses arranged in a single row one above the other.

43. A shaft element composed of molding material, comprising a shaft member having a hollow interior; at least one support provided in said interior of said shaft member so that a person can step on said support, said support being an integral component part of said shaft member, said shaft member having an extension, said support being formed in the region of said extension; and at least one additional such support, said supports being formed as recesses and arranged in pairs so as to be laterally and vertically offset relative to one another.

44. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said support being formed as a recess extending in an approximately curved manner as seen in a vertical cross-section.

45. A shaft element composed of molding material, comprising a shaft member having a hollow interior; and at least one support provided in said interior of said shaft member so that a person can step on said support, said support being an integral component part of said shaft member, said shaft member having an extension, said support being formed in the region of said extension, said support being formed as a recess having a substantial rectangular shape as seen in vertical cross-sections.

* * * * *